US010371145B2

(12) United States Patent
Johnston et al.

(10) Patent No.: US 10,371,145 B2
(45) Date of Patent: Aug. 6, 2019

(54) PISTON ROD HAVING CAP RECESS

(71) Applicant: Graco Minnesota Inc., Minneapolis, MN (US)

(72) Inventors: Justin G. Johnston, Rogers, MN (US); Andrew J. Kopel, Stanchfield, MN (US); Brian M. Mulgrew, St. Francis, MN (US); Steve J. Wrobel, Rogers, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 167 days.

(21) Appl. No.: 15/404,728

(22) Filed: Jan. 12, 2017

(65) Prior Publication Data

US 2017/0198690 A1 Jul. 13, 2017

Related U.S. Application Data

(60) Provisional application No. 62/277,832, filed on Jan. 12, 2016.

(51) Int. Cl.
*F04B 53/14* (2006.01)
*B05B 9/04* (2006.01)
(Continued)

(52) U.S. Cl.
CPC ..... *F04B 53/144* (2013.01); *B05B 9/0413* (2013.01); *F04B 1/0413* (2013.01);
(Continued)

(58) Field of Classification Search
CPC ..... F04B 9/042; F04B 53/14; F04B 53/145; F04B 53/146; F04B 53/147; F16J 1/005; F16J 1/006; F16J 1/10
See application file for complete search history.

(56) References Cited

U.S. PATENT DOCUMENTS 3,502,029 A 3/1970 Halladay
3,827,339 A 8/1974 Rosen et al.
(Continued)

FOREIGN PATENT DOCUMENTS

AT 318334 B 10/1974
CN 201407165 Y 2/2010
(Continued)

OTHER PUBLICATIONS

Extended European Search Report for EP Application No. 17151120.7, dated Jun. 2, 2017, 8 Pages.
(Continued)

*Primary Examiner* — Michael Leslie
*Assistant Examiner* — Matthew Wiblin
(74) *Attorney, Agent, or Firm* — Kinney & Lange, P.A.

(57) ABSTRACT

A piston rod for pumping paint includes an elongated cylindrical stem and a piston rod cap connected to the cylindrical stem. The cylindrical stem is formed from metal and has an outer diameter that is uniform along most or all of a length of the cylindrical stem. The piston rod cap is cylindrical and formed from metal. The piston rod cap includes an annular top portion that has an outer diameter that is larger than the outer diameter of the cylindrical stem, an annular bottom portion that has an outer diameter that is larger than the outer diameter of the cylindrical stem, and an exterior recess located between the annular top and bottom portions. The recess has an outer diameter that is smaller than the outer diameters of the annular top and bottom portions.

37 Claims, 14 Drawing Sheets

(51) Int. Cl.

| | |
|---|---|
| ***F04B 1/04*** | (2006.01) |
| ***F04B 1/053*** | (2006.01) |
| ***F04B 9/04*** | (2006.01) |
| ***F04B 15/02*** | (2006.01) |
| ***F04B 17/06*** | (2006.01) |
| ***F04B 53/02*** | (2006.01) |

(52) U.S. Cl.

CPC ..... *F04B 1/0426* (2013.01); *F04B 1/0531* (2013.01); *F04B 9/042* (2013.01); *F04B 15/02* (2013.01); *F04B 17/06* (2013.01); *F04B 53/02* (2013.01); *F04B 53/14* (2013.01); *F04B 53/146* (2013.01); *F04B 53/147* (2013.01)

(56) References Cited

U.S. PATENT DOCUMENTS

| | | | | | |
|---|---|---|---|---|---|
| 4,009,971 | A | | 3/1977 | Krohn et al. | |
| 4,044,655 | A | * | 8/1977 | Kennicott | F04B 39/0005 92/258 |
| 4,208,953 | A | * | 6/1980 | Prusic | F04B 39/0005 92/182 |
| 4,757,751 | A | * | 7/1988 | Munoz | F04B 53/147 92/165 R |
| 5,201,638 | A | | 4/1993 | Bieri | |
| 5,228,842 | A | * | 7/1993 | Guebeli | B05B 9/0413 277/530 |
| 5,346,037 | A | | 9/1994 | Flaig et al. | |
| 5,573,386 | A | | 11/1996 | Schmitt et al. | |
| 5,655,885 | A | * | 8/1997 | Chung | F04B 5/02 417/360 |
| 6,435,846 | B1 | | 8/2002 | Cooper et al. | |
| 6,599,107 | B2 | * | 7/2003 | Cooper | F04B 17/03 417/415 |
| 7,071,429 | B1 | | 7/2006 | Anderson et al. | |
| 8,177,524 | B1 | | 5/2012 | Kieffer et al. | |

FOREIGN PATENT DOCUMENTS

| | | | | |
|---|---|---|---|---|
| CN | 102652223 | A | 8/2012 | |
| CN | 203441736 | U | 2/2014 | |
| CN | 103939311 | A | 7/2014 | |
| DE | 4327549 | A1 | 2/1995 | |
| DE | 19836901 | C2 | 2/2000 | |
| DE | 102013224707 | A1 * | 6/2015 | F04B 1/0408 |
| GB | 2044347 | A | 10/1980 | |

OTHER PUBLICATIONS

First Chinese Office Action for CN Application No. 2017100218490, dated Jul. 18, 2018, 30 Pages.

* cited by examiner

PISTON ROD HAVING CAP RECESS

CROSS-REFERENCE TO RELATED APPLICATION(S)

This application claims the benefit of U.S. Provisional Application No. 62/277,832 filed Jan. 12, 2016 for "PISTON ROD HAVING PUMP HEAD RECESS" by Justin G. Johnston, Andrew J. Kopel, Brian M. Mulgrew, and Steve J. Wrobel, which is fully incorporated by reference herein.

BACKGROUND

The present disclosure relates generally to fluid dispensing systems, and in particular, to a piston pump assembly for fluid dispensing systems.

Fluid dispensing systems may be used to spray solutions such as paint onto a desired surface. Fluid dispensing systems such as paint sprayers often include piston pump assemblies to move paint through the system from a reservoir to a spray gun. During use, paint sprayers are subjected to contaminants, such as paint and dirt and debris from the surrounding environment. As a result, sprayers may require maintenance while in the field. Usually the piston pump assembly must be removed from the sprayer to service the components of the piston pump assembly and the other components of the sprayer. Therefore, a piston pump assembly that reduces and simplifies required field maintenance is needed.

SUMMARY

A piston rod for pumping paint includes an elongated cylindrical stem and a piston rod cap connected to the cylindrical stem. The cylindrical stem is formed from metal and has an outer diameter that is uniform along most or all of a length of the cylindrical stem. The piston rod cap is cylindrical and formed from metal. The piston rod cap includes an annular top portion that has an outer diameter that is larger than the outer diameter of the cylindrical stem, an annular bottom portion that has an outer diameter that is larger than the outer diameter of the cylindrical stem, and an exterior recess located between the annular top and bottom portions. The recess has an outer diameter that is smaller than the outer diameters of the annular top and bottom portions.

A piston rod for pumping paint includes an elongated cylindrical stem and a piston rod cap connected to the cylindrical stem. The cylindrical stem is formed from a first piece of metal and has an outer diameter that is uniform along most or all of a length of the cylindrical stem. The piston rod cap is formed from a second piece of metal that is separate from the first piece of metal. The piston rod cap includes an annular top portion having an outer diameter that is larger than the outer diameter of the cylindrical stem, an annular bottom portion having an outer diameter that is larger than the outer diameter of the cylindrical stem, an exterior recess located between the annular top and bottom portions, and a cavity that receives a top portion of the cylindrical stem. The annular top portion has a top surface that is flat. The recess includes an annular groove that extends around an entire circumference of the piston rod cap, and the recess has an outer diameter that is smaller than the outer diameters of the annular top and bottom portions.

A piston pump assembly for pumping paint includes a piston rod and a packing retainer. The piston rod includes an elongated cylindrical stem formed from a first piece of metal and a piston rod cap connected to the cylindrical stem. The cylindrical stem has an outer diameter that is uniform along most or all of a length of the cylindrical stem. The piston rod cap includes an annular top portion having an outer diameter that is larger than the outer diameter of the cylindrical stem, an annular bottom portion having an outer diameter that is larger than the outer diameter of the cylindrical stem, a recess located between the annular top and bottom portions, and a cavity that receives a top portion of the cylindrical stem to connect the piston rod cap to the cylindrical stem. The annular top portion has a top surface that is flat. The annular bottom portion has an annular bottom surface that is flat. The recess is smaller in outer diameter than the annular top and bottom portions and includes an annular groove that extends around an entire circumference of the piston rod cap. The packing retainer surrounds a portion of the cylindrical stem such that the cylindrical stem extends out of opposite sides of the packing retainer and the piston rod cap is outside of the packing retainer. The packing retainer holds one or more packing seal rings around and in contact with the cylindrical stem.

DETAILED DESCRIPTION

In general, the present disclosure describes a piston rod cap having a recess in a sidewall that reduces insertion force between the piston rod cap and a yoke of a paint sprayer by decreasing the surface area of the piston rod cap that interferes with the yoke. The recess also provides a gap to trap contamination, such as paint, dirt, debris, or other particles. As such, the recess makes the piston pump assembly easier to assemble and disassemble, and therefore makes the sprayer easier to service in the field. It also prolongs the life of various components of the sprayer by preventing or at least slowing their wear from contaminants.

Figure 1:
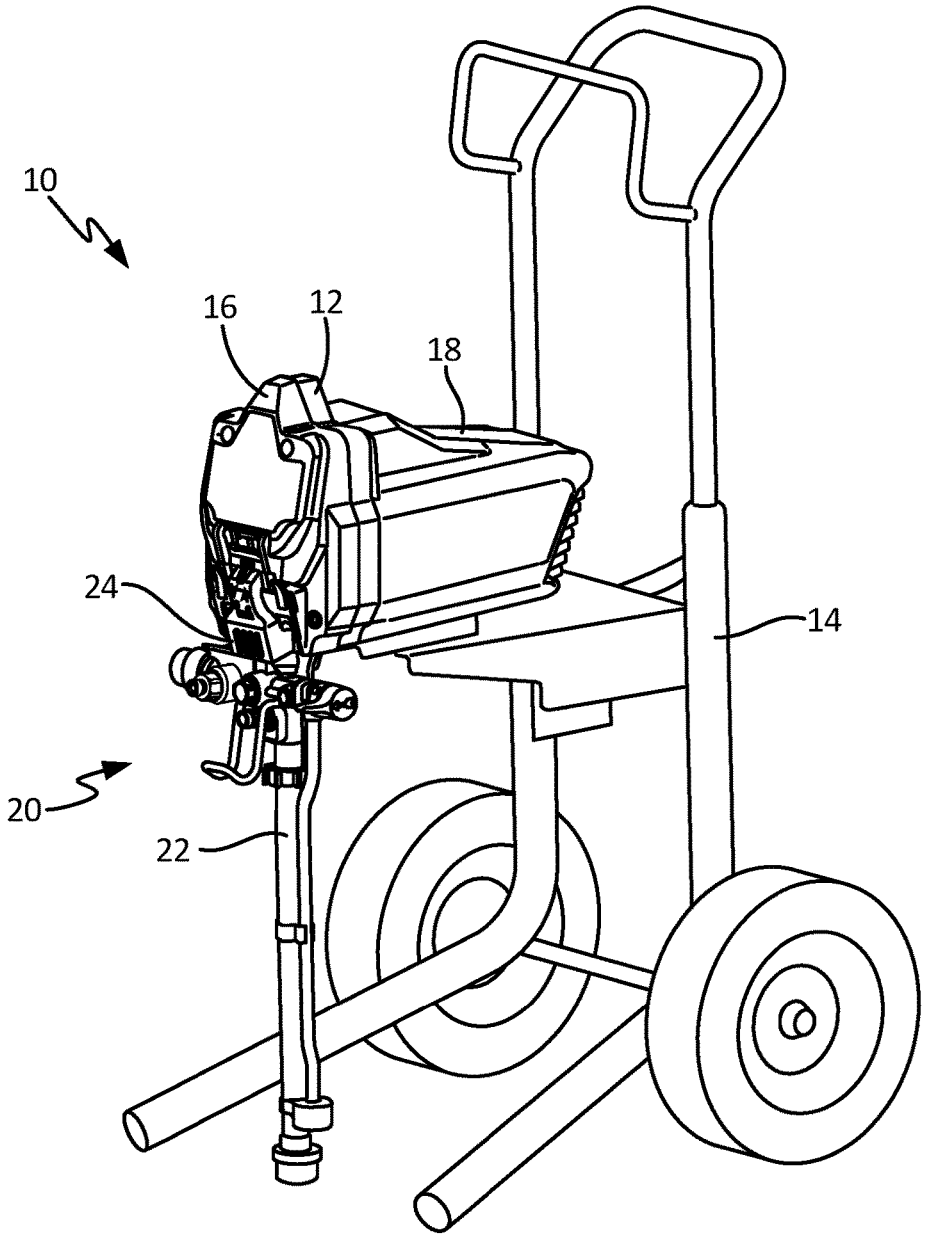
FIG. 1 is a perspective view of a sprayer with a door in a closed position.

FIG. 1 is a perspective view of sprayer 10, which includes end bell 12, frame 14, front cover 16, motor housing 18, piston pump assembly 20, and intake hose 22. Front cover 16 includes door 24, which is in a closed position.

End bell 12 is mounted on frame 14. Front cover 16 is attached to a front side of end bell 12 and motor housing 18 is attached to a back side of end bell 12. Front cover 16 can be secured to the front side of end bell 12 with a plurality of screws that extend through front cover 16 and screw into end bell 12. Piston pump assembly 20 can be mounted to a front side of end bell 12. Intake hose 22 is attached to a bottom end of piston pump assembly 20. Door 24 is movably attached to a bottom end of front cover 16. In alternate embodiments, front cover 16 may not include door 24. In such embodiments, front cover 16 extends over the area where door 24 would have been located.

End bell 12 acts as a structural element to support front cover 16 and motor housing 18 on frame 14. Front cover 16 partially contains, covers, supports, and/or protects various components of sprayer 10. Motor housing 18 contains an electric motor (not shown) to drive piston pump assembly 20. End bell 12 also supports piston pump assembly 20. Piston pump assembly 20 causes intake hose 22 to suck paint out of a reservoir and deliver it to piston pump assembly 20. The paint is further directed out of piston pump assembly 20 through a hose (not shown) to a gun assembly (not shown) for spraying on a desired surface.

Figure 2A:
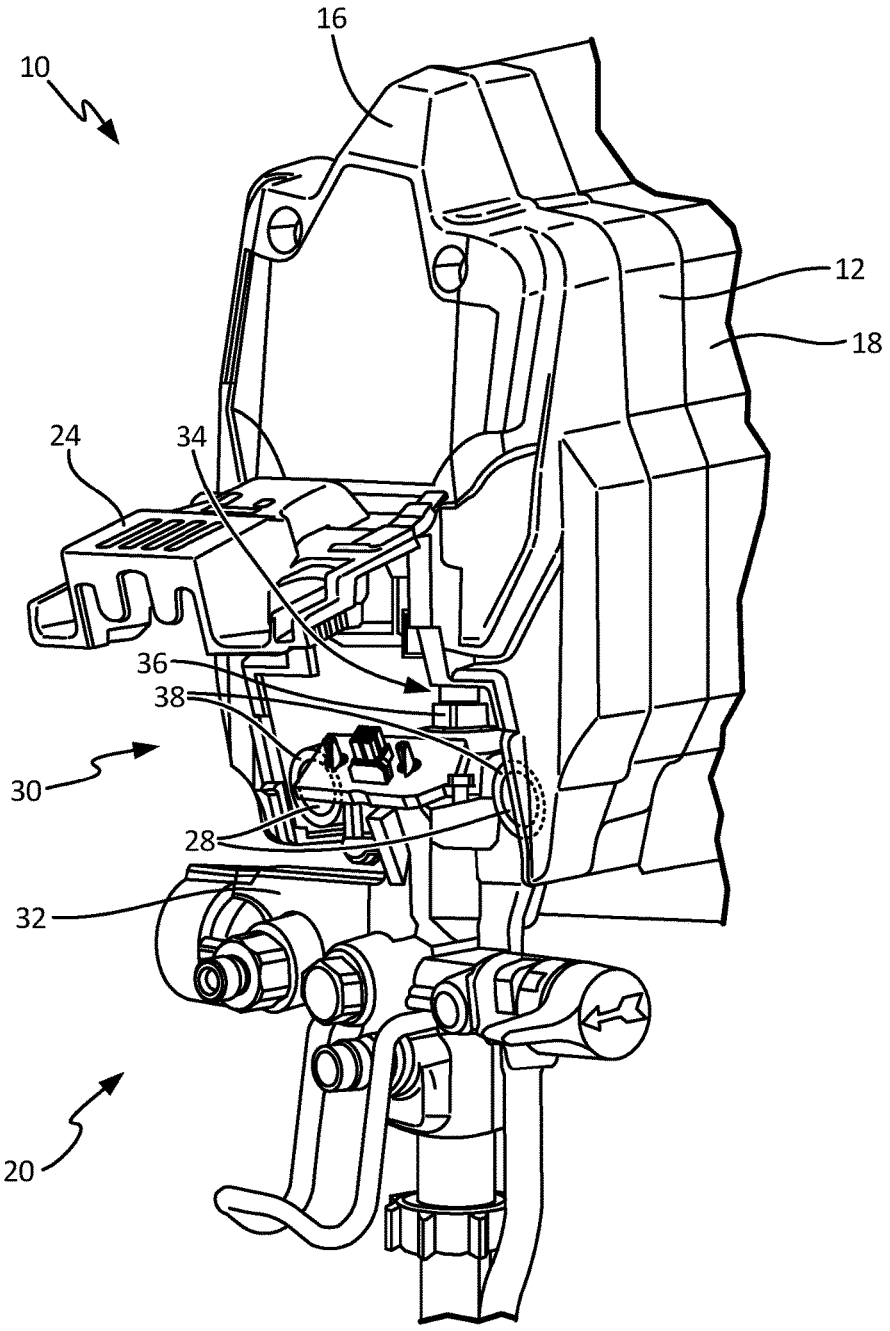
FIG. 2A is a partial perspective view of the sprayer with the door in an open position showing a piston pump assembly mounted on an end bell.
Figure 2B:
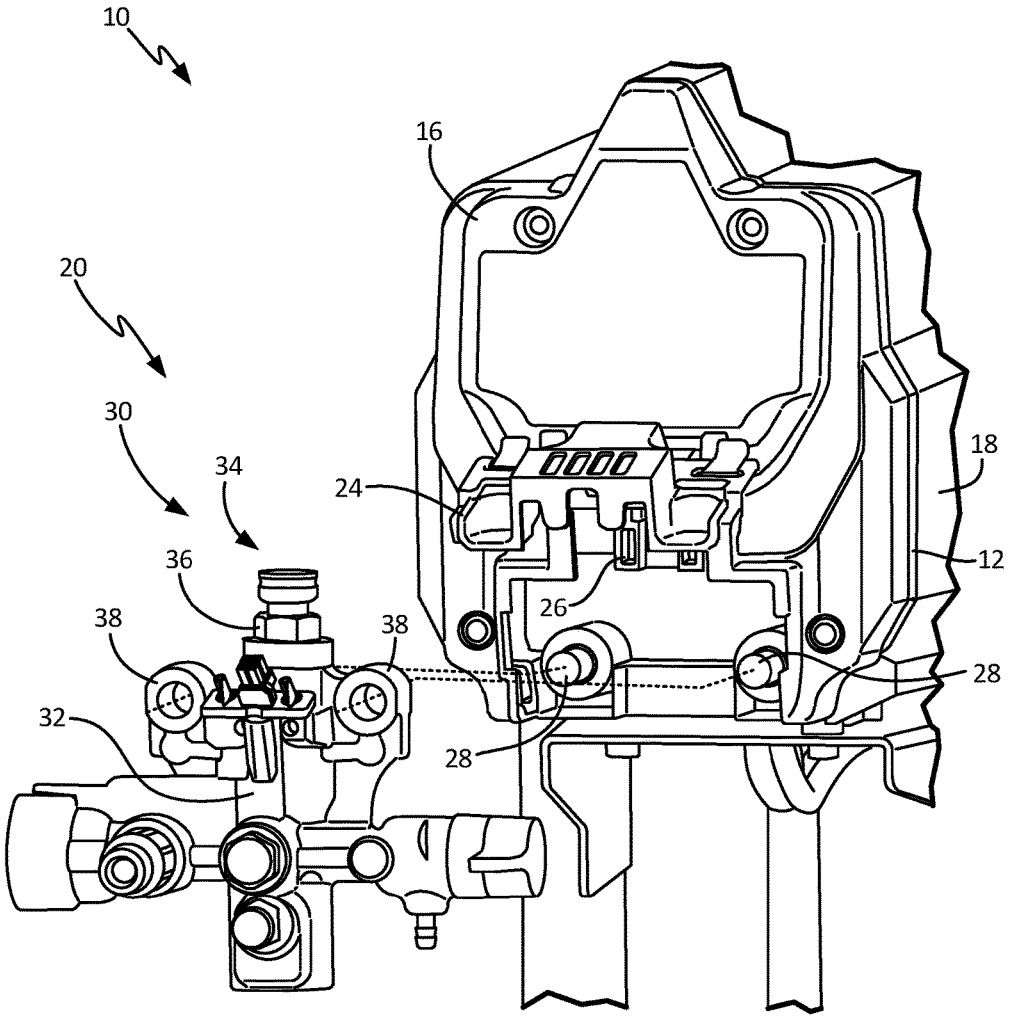
FIG. 2B is a partial perspective view of the sprayer with the door in an open position showing the piston pump assembly dismounted from the end bell.

FIG. 2A is a partial perspective view of sprayer 10 with door 24 in an open position showing piston pump assembly 20 mounted on end bell 12. FIG. 2B is a partial perspective view of sprayer 10 with door 24 in an open position showing piston pump assembly 20 dismounted from end bell 12. FIGS. 2A and 2B show sprayer 10, which includes end bell 12, front cover 16, motor housing 18, piston pump assembly 20, and yoke 26 (shown in FIG. 2B). Front cover 16 includes door 24. End bell 12 includes pins 28. Piston pump assembly 20 includes piston rod assembly 30 and pump housing 32. Piston rod assembly 30 includes piston rod 34 and packing retainer 36. Pump housing 32 includes receivers 38.

Sprayer 10 has end bell 12 with front cover 16 attached to a front side of end bell 12 and motor housing 18 attached to a back side of end bell 12. A top of piston pump assembly 20 can be mounted to a front side of end bell 12 near the bottom of end bell 12 (shown in FIG. 2A). The top of piston pump assembly 20 is mounted to front side of end bell 12 interior to front cover 16. Yoke 26 is also attached to a front side of end bell 12 interior to front cover 16. Door 24 is movably attached to a bottom end of front cover 16 near the top of piston pump assembly 20. First ends of pins 28 are connected to a front of end bell 12 near the bottom of end bell 12 such that they are cantilevered from end bell 12. Pins 28 are connected to end bell 12 below yoke 26 and interior to door 24 of front cover 16. Pins 28 may be unitary parts of end bell 12 or fixed to end bell 12. Pins 28 are not mechanically supported by front cover 16. Pins 28 may be formed from metal.

A bottom end of piston rod assembly 30 extends into a top of pump housing 32 and is surrounded by pump housing 32. In this embodiment, piston rod assembly 30 is partially contained within pump housing 32. A bottom end of piston rod 34 extends into the top of pump housing 32 and a top end of piston rod 34 is insertable into yoke 26. Packing retainer 36 surrounds piston rod 34 and a bottom end of packing retainer 36 extends into the top of pump housing 32. More specifically, packing retainer 36 may thread into pump housing 32. Receivers 38 are apertures at a top of pump housing 32. More specifically, the apertures of receivers 38 extend entirely through pump housing 32. In alternate embodiments, the apertures of receivers 38 may extend only partially through pump housing 32. A first receiver 38 is at a first side of pump housing 32 and a second receiver 38 is at a second side of pump housing 32. Receivers 38 may be apertures of a size and shape that corresponds with the size and shape of pins 28.

As shown in FIG. 2A, threading receivers 38 onto pins 28, such that pins 28 are received within receivers 38, can mount piston pump assembly 20 to pins 28 and therefore to a front side of end bell 12. Pins 28 are load bearing, and all or essentially all of the load or weight of piston pump assembly 20 can be supported by pins 28. The weight of piston pump assembly 20 is not supported by front cover 16. Additionally, in order to mount piston pump assembly 20 to end bell 12, a top of piston rod 34 must be inserted into yoke 26. Likewise, as shown in FIG. 2B, removing receivers 38 from pins 28 and piston rod 34 from yoke 26 can dismount piston pump assembly 20 from end bell 12. Forward sliding motion can remove receivers 38 from pins 28 and disengage piston rod 34 from yoke 26. Door 24 is movable from a closed position (as shown in FIG. 1) to an open position (as shown in FIGS. 2A and 2B). By moving door 24 to an open position, piston pump assembly 20 may be mounted to or dismounted from end bell 12 without removing front cover 16. Door 24 in a closed position can contact or be very close to second ends of pins 28 to prevent piston pump assembly 20 from sliding off pins 38.

Piston pump assembly 20 is mounted to end bell 12 for sprayer 10 to function properly. On the other hand, piston pump assembly 20 is dismounted from end bell 12 for sprayer 10, and particularly piston pump assembly 20, to be serviced for maintenance. For example, seal assemblies, check valves, and other components of piston pump assembly 20 can be cleaned or replaced when piston pump assembly 20 is dismounted. Additionally, door 24 in a closed position may prevent forward sliding motion of piston pump assembly 20 but does not otherwise provide any limitation on the movement of piston pump assembly 20 or support the weight of piston pump assembly 20.

Figure 3A:
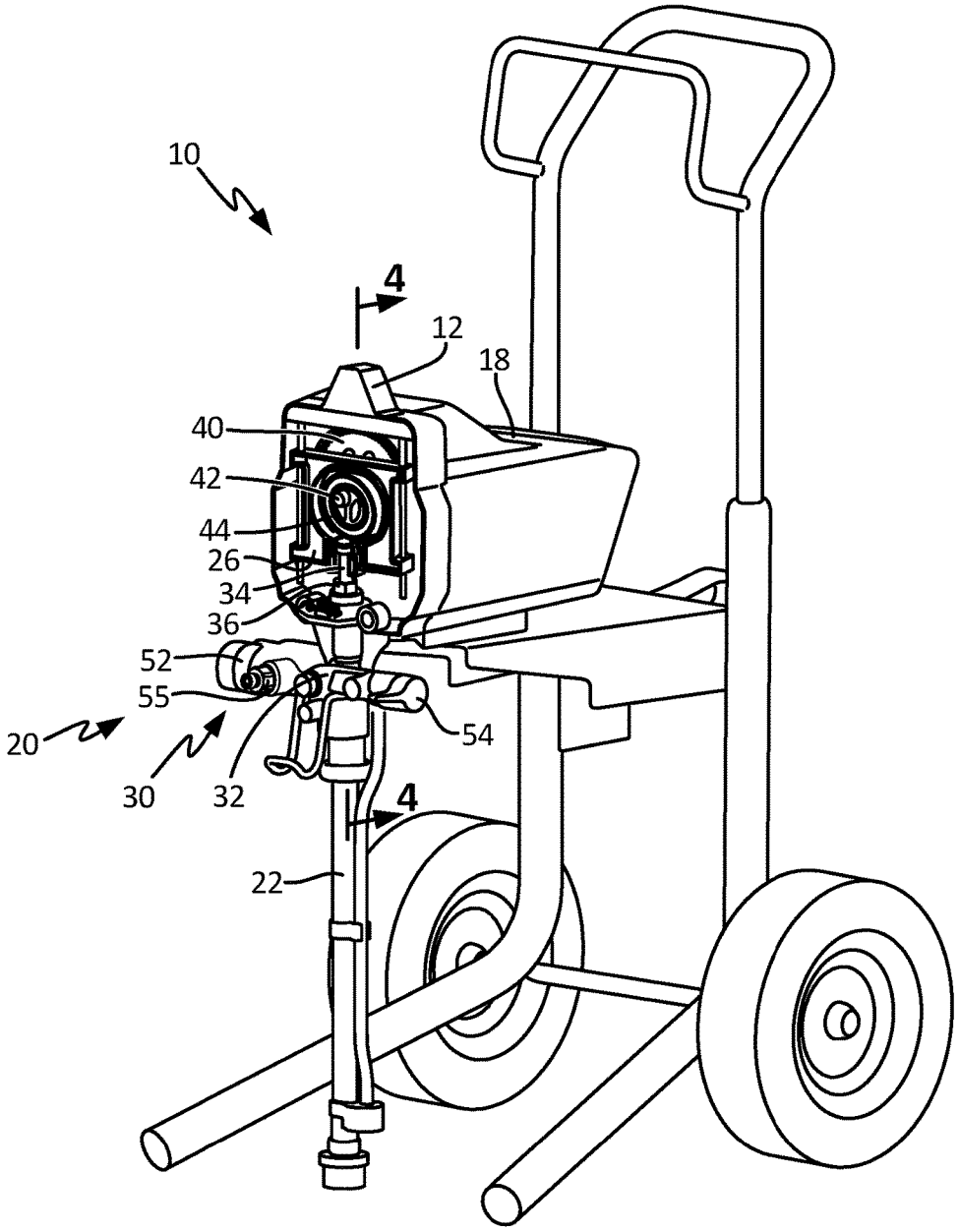
FIG. 3A is a perspective view of the sprayer with a front cover removed.
Figure 3B:
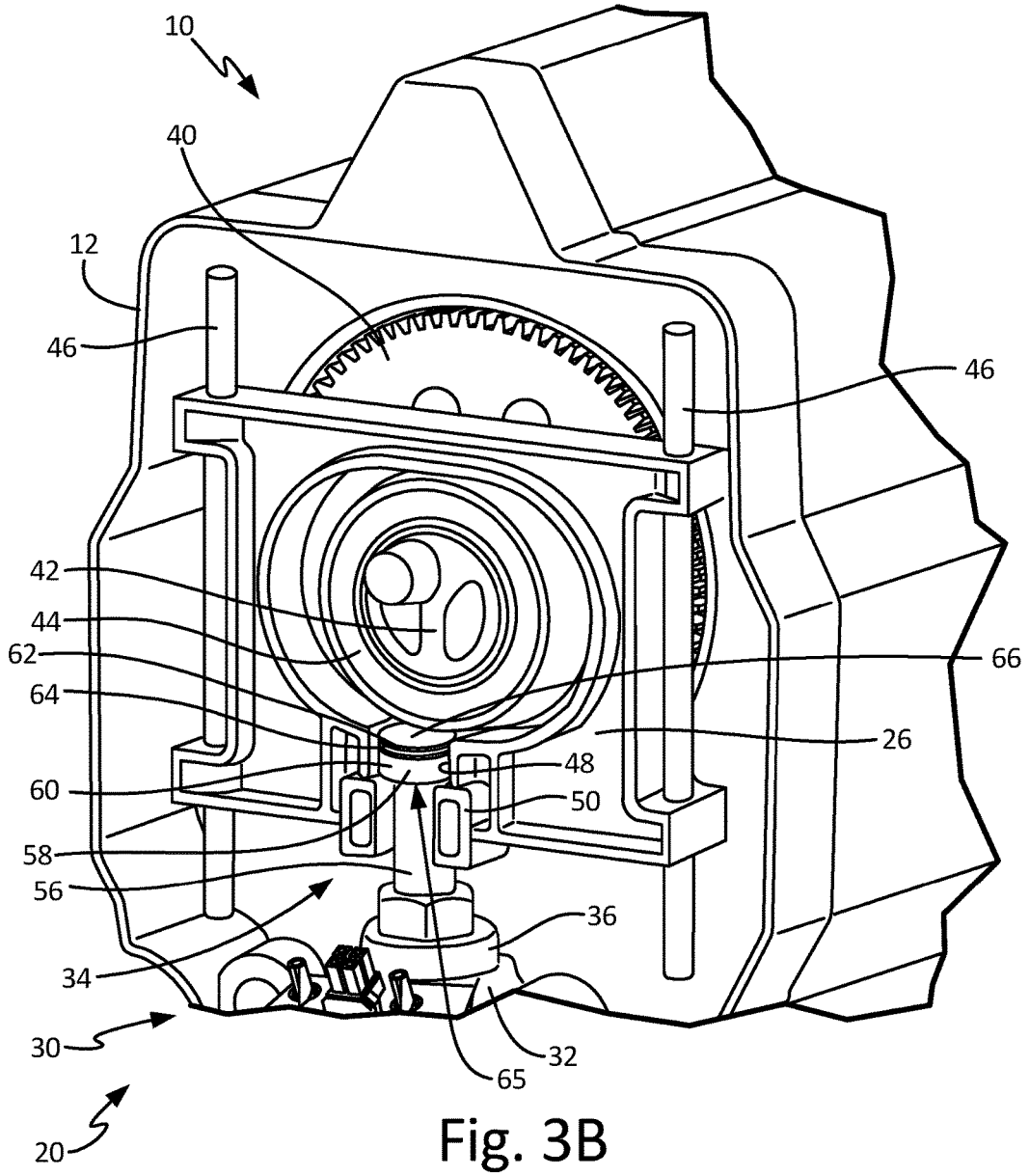
FIG. 3B is an enlarged partial perspective view of the sprayer with the front cover removed.

FIG. 3A is a perspective view of sprayer 10 with front cover 16 removed. FIG. 3B is an enlarged partial perspective view of sprayer 10 with front cover 16 removed. FIGS. 3A and 3B show sprayer 10. Sprayer 10 includes end bell 12, motor housing 18, piston pump assembly 20, intake hose 22, yoke 26, gearing 40, eccentric 42, bearing 44, guide posts 46 (shown in FIG. 3B). Yoke 26 includes pocket 48 and shoulders 50. Piston pump assembly 20 includes piston rod assembly 30, pump housing 32, pressure control 52 (shown in FIG. 3A), prime control 54 (shown in FIG. 3A), and output port 55 (shown in FIG. 3A). Piston rod assembly 30 includes piston rod 34 and packing retainer 36. Piston rod 34 includes stem 56 (shown in FIG. 3B) and piston rod cap 58 (shown in FIG. 3B). Piston rod cap 58 includes bottom portion 60, top portion 62, and recess 64. Bottom portion 60 has bottom surface 65. Top portion 62 has top surface 66.

Sprayer 10 has end bell 12 with motor housing 18 attached to the back side of end bell 12. Motor housing 18 contains an electric motor (not shown) to drive piston pump assembly 20. The top of piston pump assembly 20 is mounted to the front side of end bell 12 near the bottom of end bell 12. Intake hose 22 is attached to the bottom end of piston pump assembly 20. Yoke 26 is also attached to a front side of end bell 12. Gearing 40 is located within end bell 12 behind yoke 26 and extends into motor housing 18 where it connects with the motor (not shown). Eccentric 42 is connected to gearing 40. Eccentric 42 is also positioned coaxially within bearing 44. Bearing 44 is positioned within yoke 26. Guide posts 46 attach yoke 26 to a front side of end bell 12. A first guide post 46 extends through a first side of yoke 26 and a second guide post 46 extends through a second side of yoke 26. First ends of guide posts 46 are attached to end bell 12 near a top of end bell 12 and second ends of guide posts 46 are attached to end bell 12 near a bottom of end bell 12.

Yoke 26 is rectangular with an open center and pocket 48. The open center of yoke 26 contains bearing 44. Pocket 48 is an opening located at a bottom end of yoke 26. Shoulders 50 are located adjacent a bottom end of pocket 48. Thus, the bottom end of pocket 48 is narrower than a top end of pocket 48. Yoke 26 may be made of plastic or metal.

Piston pump assembly 20 is mounted to end bell 12 at piston rod assembly 30. Pump housing 32 surrounds a bottom end of piston rod assembly 30. Pressure control 52 is attached to a first side of pump housing 32 and prime control 54 is attached to a second side of pump housing 32. In alternate embodiments, sprayer does not include pressure control 52 or prime control 54 or both pressure control 52 and prime control 54. Output port 55 is located at a front side of pump housing 32 positioned between pressure control 52 and prime control 54. Output port 55 has a fitting attached to output port 55.

Piston rod assembly 30 has piston rod 34 surrounded by packing retainer 36. Packing retainer 36 is spaced from a top of piston rod 34 and a bottom of piston rod 34. A bottom end of piston rod 34 and a bottom end of packing retainer 36 extend into the top of pump housing 32.

Piston rod 34 has stem 56 with a top end attached to piston rod cap 58. Stem 56 is elongated and cylindrical and may or may not extend through piston rod cap 58. Stem 56 has an outer diameter that is uniform along most or all of a length of stem 56. As such, stem 56 may have an outer diameter that is uniform along the entire length of stem 56. Stem 56 is narrower or smaller in outer diameter than piston rod cap 58. A bottom end of stem 56 is configured to contact and pump paint by reciprocation of stem 56. Stem 56 is surrounded by packing retainer 36 such that a bottom end of stem 56 and a bottom end of packing retainer 36 extend into the top of pump housing 32. Packing retainer 36 also surrounds a portion of stem 56 such that stem 56 extends out of opposite sides of packing retainer 36 and piston rod cap 58 is outside of packing retainer 36. Stem 56 is formed from metal. Piston rod cap 58 is cylindrical and formed from metal. Piston rod 34 may consist only of stem 56 and piston rod cap 58.

Piston rod cap 58 has bottom portion 60 at a bottom of piston rod cap 58. Bottom portion 60 is attached to the top end of stem 56. Bottom portion 60 is annular. Bottom portion 60 has an outer diameter that is larger than the outer diameter of stem 56. Bottom portion 60 may have a constant outer diameter from a bottom of bottom portion 60 to a top of bottom portion 60. Top portion 62 is at a top of piston rod cap 58. Top portion 62 is annular. Top portion 62 has an outer diameter that is larger than the outer diameter of stem 56. Top portion 62 may have a constant outer diameter from a bottom of top portion 62 to a top of top portion 62. Additionally, top portion 62 and bottom portion 60 may have outer diameters that are equal. Recess 64 is located in an exterior portion of piston rod cap 58 between bottom portion 60 and top portion 62. Recess 64 has an outer diameter that is smaller than the outer diameters of bottom portion 60 and top portion 62. As such, piston rod cap 58 is thinner or smaller in outer diameter along recess 64 and thicker or larger in outer diameter above and below recess 64. Recess 64 can be annular and wrap or extend entirely around a circumference of piston rod cap 58. Recess 64 may be a groove, notch, depression, trench, slot, or indentation. Recess 64 may have a rounded concave cup-shaped cross-sectional profile as shown in FIGS. 3A and 3B or it may have a V-shaped cross-sectional profile, square-shaped cross-sectional profile, saw-tooth-shaped cross-sectional profile or a cross-sectional profile of any other suitable shape. Recess 64 may be milled into piston rod cap 58. Bottom portion 60, top portion 62, and recess 64 together make up a sidewall of piston rod cap 58.

Bottom portion 60 has bottom surface 65 at a bottom of bottom portion 60. Bottom surface 65 connects to stem 56. Bottom surface 65 is annular and flat. In alternate embodiments, bottom surface 65 may not be flat. Top portion 62 has top surface 66 at a top of top portion 62. Top surface 66 is flat. In alternate embodiments, top surface 66 may not be flat.

A top end of stem 56 and piston rod cap 58 are insertable into pocket 48 in yoke 26 such that yoke 26 cradles piston rod cap 58. As such, bottom surface 65 of bottom portion 60 of piston rod cap 58 is adjacent to and may contact tops of shoulders 50. In this embodiment piston rod cap 58 fits into yoke 26 in a manner that is not snug. A gap between piston rod cap 58 and yoke 26 exits such that the gap is greater toward a front side of yoke 26 than a back side of yoke 26. In alternate embodiments, pocket 48 may be slightly smaller than piston rod cap 58 such that a press fit is formed between yoke 26 and piston rod cap 58.

The gearing 40, eccentric 42, bearing 44, and yoke 26 of sprayer 10 work together to convert rotational output motion of the motor into linear up-and-down reciprocating motion of piston rod 34. The motor (not shown) of sprayer 10 drives the gearing 40, which in turn rotates eccentric 42. Eccentric 42 moves bearing 44 within the open center of yoke 26 in an upward direction and a downward direction while rotating. Bearing 44 moves yoke 26 in a downward direction and contacts or slides across top surface 66 of top portion 62 of piston rod cap 58 to force piston rod 34 in a downward direction during a downstroke of a pump cycle. When bearing 44 moves yoke 26 in an upward direction, tops of shoulders 50 of yoke 26 contact bottom surface 65 of bottom portion 60 of piston rod cap 58 and lift piston rod 34 in an upward direction during an upstroke of the pump cycle. As such, yoke 26 linearly moves piston rod 34 as yoke 26 moves. A bottom of stem 56 contacts paint and pumps the paint by reciprocation of stem 56. Pressure control 52 controls pressure regulation of piston pump assembly 20 and prime control 54 controls priming of piston pump assembly 20. Movement of piston rod 34 between downward and upward directions draws paint from a reservoir (not shown)

into piston pump assembly 20 through intake hose 22, and forces paint out of piston pump assembly 20 through output port 55 and a hose (not shown) to a gun assembly (not shown) for spraying on a desired surface.

Figure 4:
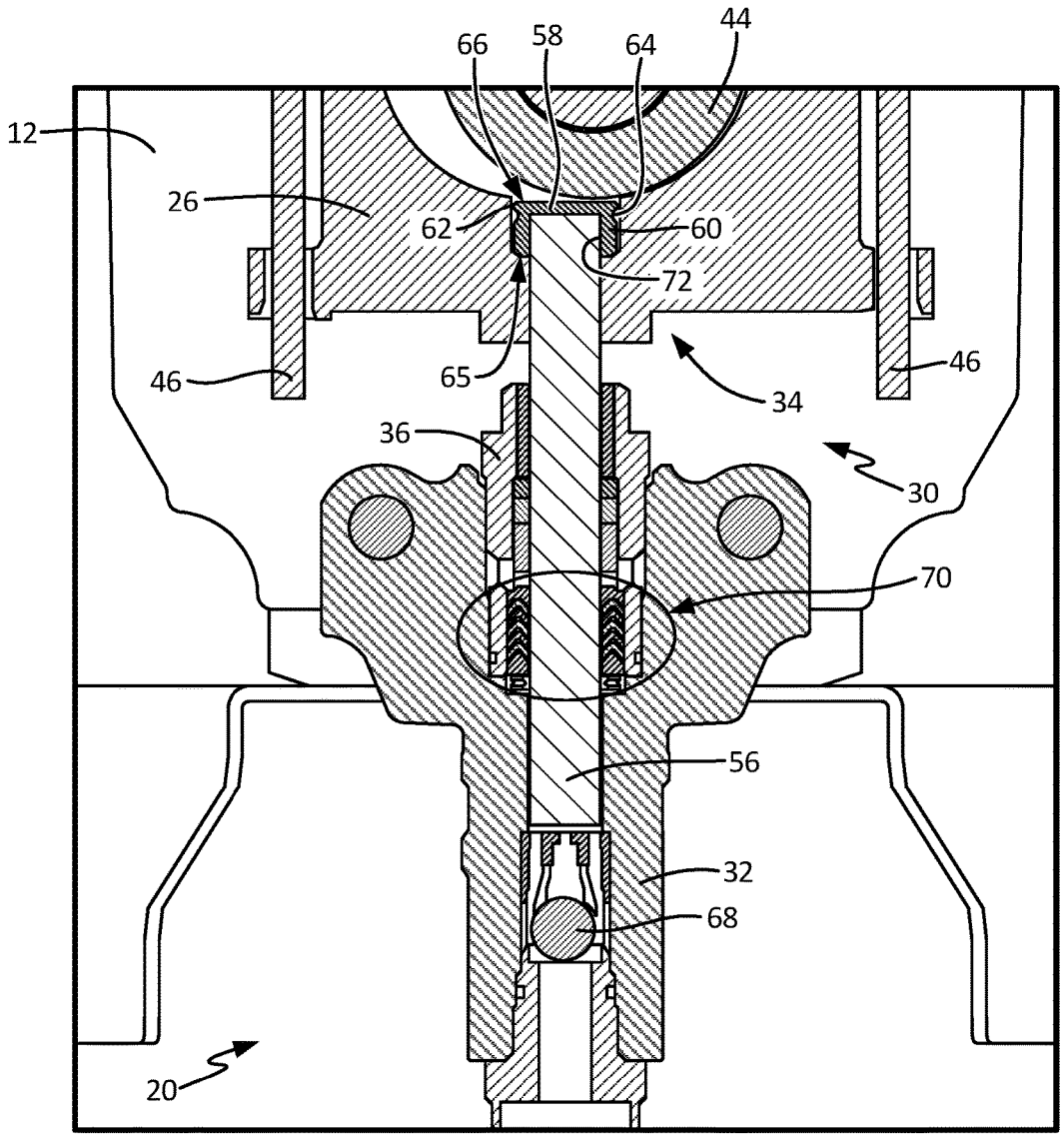
FIG. 4 is a front cross-sectional view of the sprayer taken along line 4-4 of FIG. 3A.

FIG. 4 is a front cross-sectional view of sprayer 10 taken along line 4-4 of FIG. 3A. Sprayer 10 includes end bell 12, piston pump assembly 20, yoke 26, bearing 44, and guide posts 46. Piston pump assembly 20 includes piston rod assembly 30, pump housing 32 and check valve 68. Piston rod assembly 30 includes piston rod 34 and packing retainer 36. Piston rod 34 includes stem 56 and piston rod cap 58. Packing retainer includes packing seal rings 70. Piston rod cap 58 includes bottom portion 60, top portion 62, recess 64, and cavity 72. Bottom portion 60 has bottom surface 65. Top portion 62 has top surface 66.

Sprayer 10 has end bell 12 with the top of piston pump assembly 20 mounted to the front side of end bell 12 near the bottom of end bell 12. Yoke 26 is also attached to a front side of end bell 12. Bearing 44 is positioned within yoke 26. Guide posts 46 attach yoke 26 to a front side of end bell 12. Piston pump assembly 20 is mounted to end bell 12 at piston rod assembly 30. Pump housing 32 surrounds a bottom end of piston rod assembly 30. Check valve 68 is located within pump housing 32. Piston rod assembly 30 has piston rod 34 surrounded by packing retainer 36. A bottom end of piston rod 34 and a bottom end of packing retainer 36 extend into the top of pump housing 32.

Piston rod 34 has stem 56 with the top end attached to piston rod cap 58. Stem 56 and piston rod cap 58 can be separate metal components. Stem 56 and piston rod cap 58 can also be made of different materials. Stem 56 is surrounded by packing retainer 36 such that a bottom end of stem 56 and a bottom end of packing retainer 36 extend into the top of pump housing 32 above check valve 68. Packing retainer 36 has packing seal rings 70 located within packing retainer 36. Any number of packing seal rings 70 may be included in packing retainer 36. Packing seal rings 70 are positioned adjacent an inner surface of packing retainer 36 and adjacent stem 56. Packing retainer 36 holds one or more packing seal rings 70 around and in contact with stem 56.

Piston rod cap 58 has annular bottom portion 60 attached to the top end of stem 56. Bottom portion 60 has an outer diameter that is larger than the outer diameter of stem 56. Annular top portion 62 is at a top of piston rod cap 58. Top portion 62 has an outer diameter that is larger than the outer diameter of stem 56. Recess 64 is located in an exterior portion of piston rod cap 58 between bottom portion 60 and top portion 62. Recess 64 has an outer diameter that is smaller than the outer diameters of bottom portion 60 and top portion 62. Recess 64 can be annular and wrap or extend entirely around a circumference of piston rod cap 58. Recess 64 may be a groove, notch, depression, trench, slot, or indentation. Recess 64 may have a rounded concave cup-shaped cross-sectional profile as shown in FIG. 4 or recess 64 may have a V-shaped cross-sectional profile, square-shaped cross-sectional profile, saw-tooth-shaped cross-sectional profile or a cross-sectional profile of any other suitable shape. Cavity 72 extends into piston rod cap 58 from bottom portion 60. A top of stem 56 fits into cavity 72. Cavity 72 receives the top of stem 56. A top end of stem 56 and piston rod cap 58 are insertable into yoke 26 such that yoke 26 cradles piston rod cap 58. Bottom portion 60 has annular bottom surface 65 at a bottom of bottom portion 60. Bottom surface 65 connects to stem 56. Top portion 62 has top surface 66 at a top of top portion 62.

Stem 56 can be press fit into cavity 72 of piston rod cap 58. Piston rod cap 58 can be press fit on the top of stem 56 to fix piston rod cap to stem 56. When piston pump assembly 20 is mounted to end bell 12, bearing 44 interacts with yoke 26 and top surface 66 of top portion 62 of piston rod cap 58 to move piston rod 34 within piston pump assembly 20. Stem 56 reciprocates in piston pump assembly 20 to pull paint through check valve 68 and ultimately out through the output port 55 (shown in FIG. 3A), hose (not shown), and the gun assembly (not shown). Further, recess 64 can be milled or otherwise formed in piston rod cap 58 before or after piston rod cap 58 is connected to stem 56.

Figure 5:
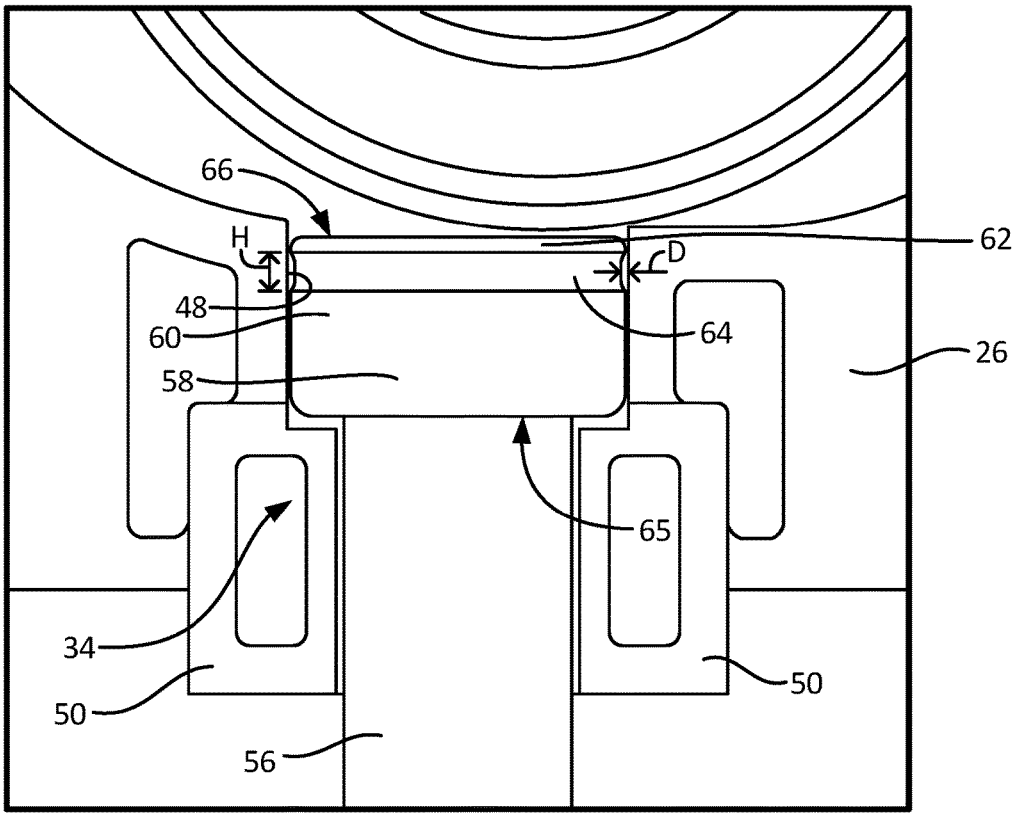
FIG. 5 is a partial front view of a first embodiment of a piston rod inserted in a yoke.
Figure 6:
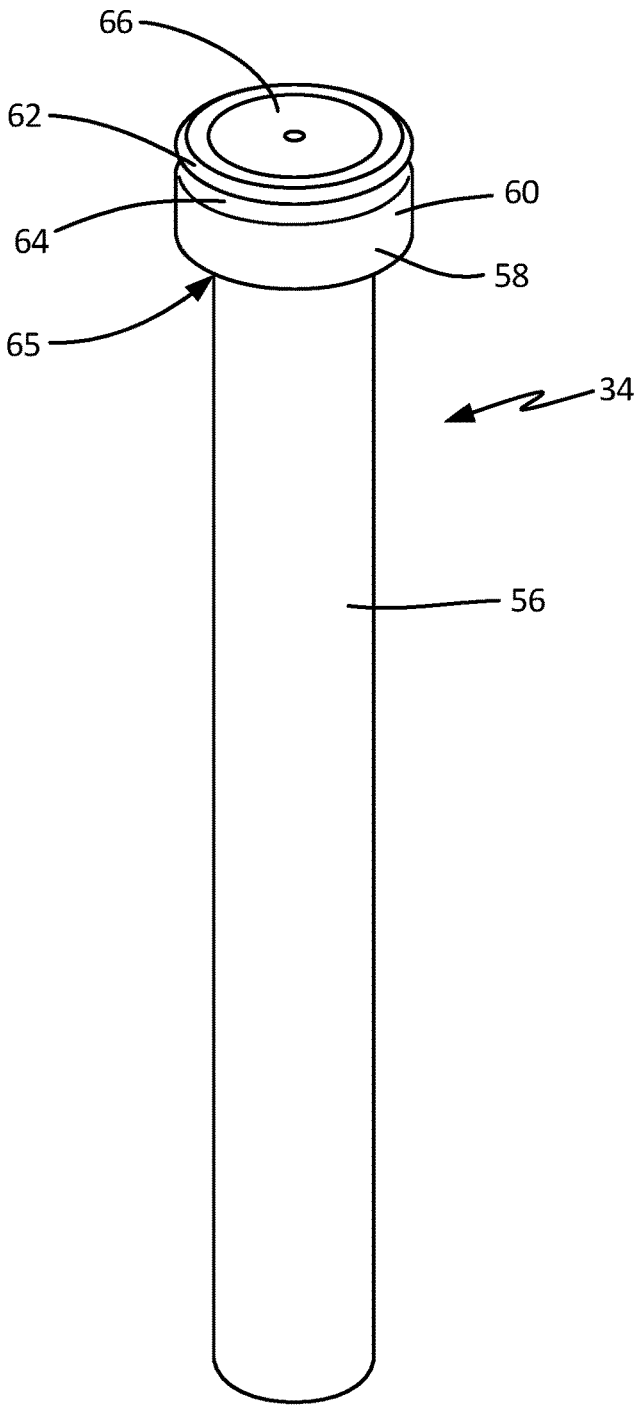
FIG. 6 is a perspective view of the first embodiment of the piston rod.

FIG. 5 is a partial front view of a first embodiment of piston rod 34 inserted in yoke 26. FIG. 6 is a perspective view of the first embodiment of piston rod 34. FIG. 5 shows yoke 26 and piston rod 34 and FIG. 6 shows piston rod 34. Yoke 26 includes pocket 48 and shoulders 50. Piston rod 34 includes stem 56 and piston rod cap 58. Piston rod cap 58 includes bottom portion 60, top portion 62, and recess 64. Bottom portion 60 has bottom surface 65. Top portion 62 has top surface 66. Recess 64 has depth D and height H.

Yoke 26 has pocket 48 located at a bottom end of yoke 26. Shoulders 50 are located adjacent a bottom end of pocket 48. A bottom end of pocket 48 is narrower than a top end of pocket 48. Likewise, a top end of pocket 48 is wider than a bottom end of pocket 48.

Piston rod 34 has stem 56 with the top end attached to piston rod cap 58. Piston rod cap 58 has annular bottom portion 60 attached to the top end of stem 56. Bottom portion 60 has an outer diameter that is larger than the outer diameter of stem 56. Annular top portion 62 is at a top of piston rod cap 58. Top portion 62 has an outer diameter that is larger than the outer diameter of stem 56. Recess 64 is located in an exterior portion of piston rod cap 58 between bottom portion 60 and top portion 62. Recess 64 has an outer diameter that is smaller than the outer diameters of bottom portion 60 and top portion 62. Recess 64 is annular and wraps entirely around a circumference of piston rod cap 58. In alternate embodiments, recess 64 may be a groove, notch, depression, trench, slot, or indentation. Recess 64 may have a preferred depth D within the range of 0.010" and 0.125", a depth D in the range of 0.010" and 0.040", or a depth D of approximately 0.040". In alternate embodiments, recess 64 may have a different depth D. Recess 64 may have a preferred height H along the length of piston rod 34 within the range of 0.060" and 0.120", or a height H along the length of piston rod 34 within the range of 0.030" and 0.375", or a height H along the length of piston rod 34 of approximately 0.100". In alternate embodiments, recess 64 may have a different height H along the length of piston rod 34. Recess 64 may have a shallow bowl or rounded concave cup-shaped cross-sectional profile as shown in FIGS. 5 and 6 or recess 64 may have a V-shaped cross-sectional profile, square-shaped cross-sectional profile, saw-tooth-shaped cross-sectional profile or a cross-sectional profile of any other suitable shape. A top end of stem 56 and piston rod cap 58 are insertable into yoke 26 such that yoke 26 cradles piston rod cap 58. Bottom portion 60 has annular bottom surface 65 at a bottom of bottom portion 60. Bottom surface 65 connects to stem 56. Top portion 62 has top surface 66 at a top of top portion 62.

Yoke 26 receives piston rod 34 at pocket 48. When piston rod 34 is inserted in yoke 26, a first side of piston rod 34 is adjacent a first side of pocket 48 and a second side of piston rod 34 is adjacent a second side of pocket 48. More specifically, pocket 48 receives the top end of stem 56 and piston rod cap 58. A bottom of pocket 48 is narrower than a top of pocket 48 to cooperate with stem 56. Likewise, a top of pocket 48 is wider than a bottom of pocket 48 to cooperate with piston rod cap 58. As such, yoke 26 is adjacent piston rod cap 58 at bottom surface 65 and at bottom portion 60 and top portion 62.

The shape of pocket 48 enables yoke 26 to cradle the top of piston rod 34, particularly piston rod cap 58. Recess 64 in piston rod cap 58 creates gaps between piston rod cap 58 and yoke 26 in pocket 48. The gaps created by recess 64 can trap paint, dirt, debris, particles, or other contamination. Such contamination is thus prevented from causing wear to various components of sprayer 10, such as yoke 26, piston rod 34, gearing 40, eccentric 42, bearing 44, and the motor (not shown). For example, recess 64 can trap contaminants that would have otherwise caused wear between yoke 26 and piston rod 34 or between piston rod 34 and other components of piston pump assembly 20. Recess 64 can also prevent paint that has leaked past packing seal rings 70 from creeping further up piston rod 34. Additionally, recess 64 reduces an outer circumferential surface area of piston rod cap 58, which results in less interference with pocket 48 of yoke 26 by piston rod cap 58. Therefore, despite a possible tight fit between piston rod 34 and yoke 26, piston rod 34 may release easier from pocket 48 due to less material causing interference during removal.

Figure 7:
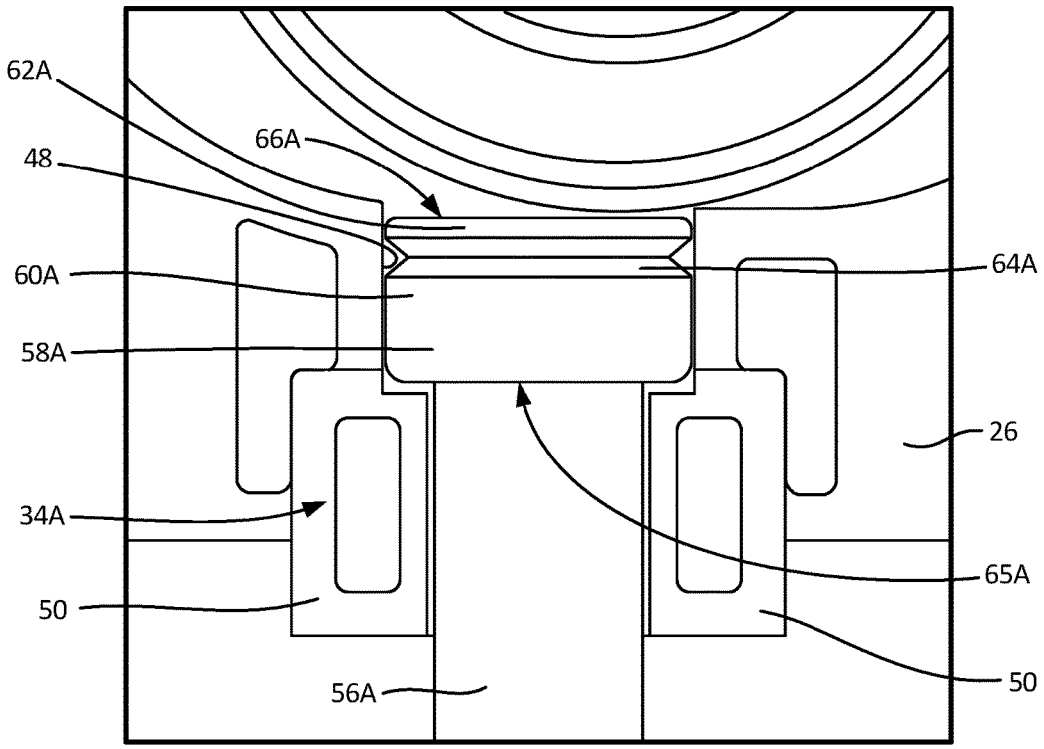
FIG. 7 is a partial front view of a second embodiment of the piston rod inserted in the yoke.

FIG. 7 is a partial front view of a second embodiment of piston rod 34A inserted in yoke 26. Yoke 26 includes pocket 48 and shoulders 50. Piston rod 34A includes stem 56A and piston rod cap 58A. Piston rod cap 58A includes bottom portion 60A, top portion 62A, and recess 64A. Bottom portion 60A has bottom surface 65A. Top portion 62A has top surface 66A.

Yoke 26 has pocket 48 located at a bottom end of yoke 26. Shoulders 50 are located adjacent a bottom end of pocket 48. A bottom end of pocket 48 is narrower than a top end of pocket 48. Likewise, a top end of pocket 48 is wider than a bottom end of pocket 48.

Piston rod 34A has stem 56A with a top end attached to piston rod cap 58A. Piston rod cap 58A has annular bottom portion 60A attached to the top end of stem 56A. Bottom portion 60A has an outer diameter that is larger than the outer diameter of stem 56A. Annular top portion 62A is at a top of piston rod cap 58A. Top portion 62A has an outer diameter that is larger than the outer diameter of stem 56A. Recess 64A is located in an exterior portion of piston rod cap 58A between bottom portion 60A and top portion 62A. Recess 64A has an outer diameter that is smaller than the outer diameters of bottom portion 60A and top portion 62A. Recess 64A is annular and extends an entire circumference of piston rod cap 58A. Recess 64A has a V-shaped cross-sectional profile. Bottom portion 60A has annular bottom surface 65A at a bottom of bottom portion 60A. Bottom surface 65A connects to stem 56A. Top portion 62A has top surface 66A at a top of top portion 62A.

Yoke 26 receives a top end of piston rod 34A at pocket 48. When piston rod 34A is inserted in yoke 26, a first side of piston rod 34A is adjacent a first side of pocket 48 and a second side of piston rod 34A is adjacent a second side of pocket 48. More specifically, pocket 48 receives the top end of stem 56A and piston rod cap 58A. A bottom of pocket 48 is narrower than a top of pocket 48 to cooperate with stem 56A. Likewise, a top of pocket 48 is wider than a bottom of pocket 48 to cooperate with piston rod cap 58A. As such, yoke 26 is adjacent piston rod cap 58A at bottom surface 65A and at bottom portion 60A and top portion 62A.

Recess 64A in piston rod cap 58A creates gaps between piston rod cap 58A and yoke 26 in pocket 48. The gaps created by recess 64A can trap paint, dirt, debris, particles, or other contamination. Such contamination is thus prevented from causing wear to various components of sprayer 10. Additionally, recess 64A reduces an outer circumferential surface area of piston rod cap 58A, which results in less interference with pocket 48 of yoke 26 by piston rod cap 58A. Therefore, despite a possible tight fit between piston rod 34A and yoke 26, piston rod 34A may release easier from pocket 48 due to less material causing interference during removal.

Figure 8:
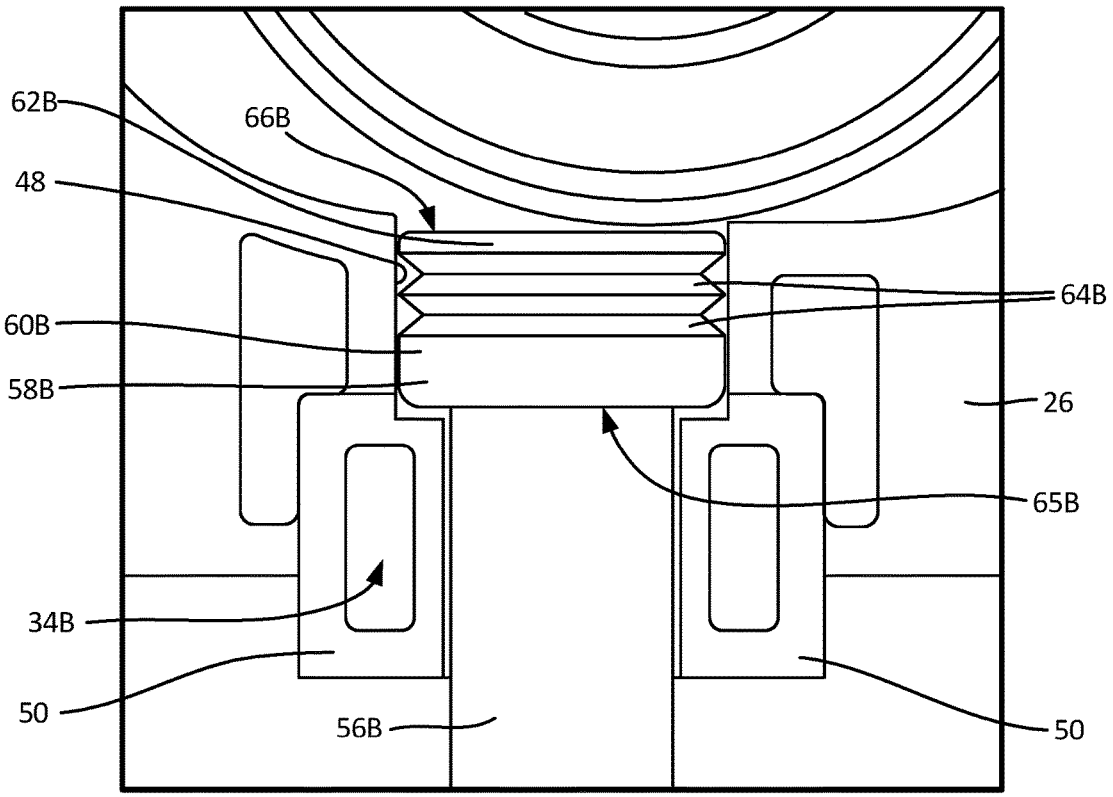
FIG. 8 is a partial front view of a third embodiment of the piston rod inserted in the yoke illustrating a plurality of recesses.

FIG. 8 is a partial front view of a third embodiment of piston rod 34B inserted in yoke 26 illustrating a plurality of recesses 64B. Yoke 26 includes pocket 48 and shoulders 50. Piston rod 34B includes stem 56B and piston rod cap 58B. Piston rod cap 58B includes bottom portion 60B, top portion 62B, and recesses 64B. Bottom portion 60B has bottom surface 65B. Top portion 62B has top surface 66B.

Yoke 26 has pocket 48 located at a bottom end of yoke 26. Shoulders 50 are located adjacent a bottom end of pocket 48. A bottom end of pocket 48 is narrower than a top end of pocket 48. Likewise, a top end of pocket 48 is wider than a bottom end of pocket 48.

Piston rod 34B has stem 56B with a top end attached to piston rod cap 58B. Piston rod cap 58B has annular bottom portion 60B attached to the top end of stem 56B. Bottom portion 60B has an outer diameter that is larger than the outer diameter of stem 56B. Annular top portion 62B is at a top of piston rod cap 58B. Top portion 62B has an outer diameter that is larger than the outer diameter of stem 56B. Recesses 64B are located in an exterior portion of piston rod cap 58B between bottom portion 60B and top portion 62B. Recesses 64B have outer diameters that are smaller than the outer diameters of bottom portion 60B and top portion 62B. Recesses 64B are adjacent each other such that there is no space between recesses 64B. Recesses 64B are annular and extend an entire circumference of piston rod cap 58B. Recesses 64B have V-shaped cross-sectional profiles. Bottom portion 60B has annular bottom surface 65B at a bottom of bottom portion 60B. Bottom surface 65B connects to stem 56B. Top portion 62B has top surface 66B at a top of top portion 62B.

Yoke 26 receives a top end of piston rod 34B at pocket 48. When piston rod 34B is inserted in yoke 26, a first side of piston rod 34B is adjacent a first side of pocket 48 and a second side of piston rod 34B is adjacent a second side of pocket 48. More specifically, pocket 48 receives the top end of stem 56B and piston rod cap 58B. A bottom of pocket 48 is narrower than a top of pocket 48 to cooperate with stem 56B. Likewise, a top of pocket 48 is wider than a bottom of pocket 48 to cooperate with piston rod cap 58B. As such, yoke 26 is adjacent piston rod cap 58B at bottom surface 65B and at bottom portion 60B and top portion 62B.

Recesses 64B in piston rod cap 58B creates gaps between piston rod cap 58B and yoke 26 in pocket 48. The gaps created by recesses 64B can trap paint, dirt, debris, particles, or other contamination. Such contamination is thus prevented from causing wear to various components of sprayer 10. Additionally, recesses 64B reduce an outer circumferential surface area of piston rod cap 58B, which results in less interference with pocket 48 of yoke 26 by piston rod cap 58B. Therefore, despite a possible tight fit between piston rod 34B and yoke 26, piston rod 34B may release easier from pocket 48 due to less material causing interference during removal.

Figure 9:
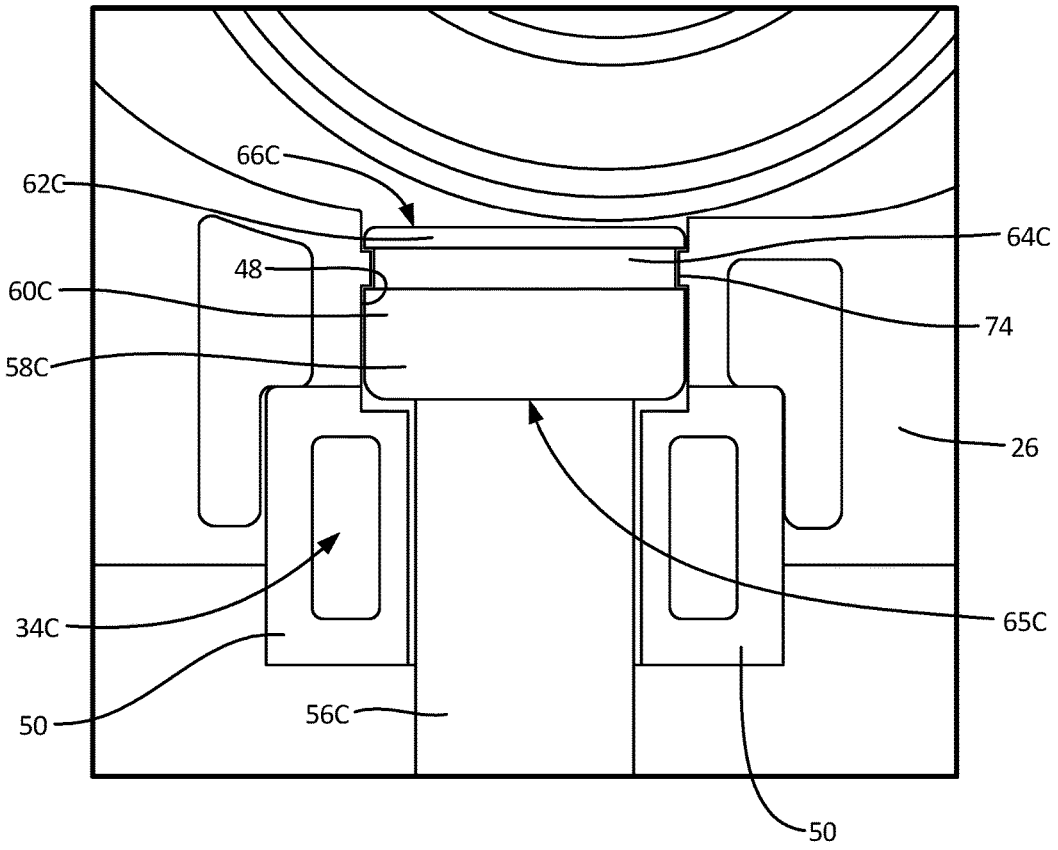
FIG. 9 is a partial front view of a fourth embodiment of the piston rod inserted in the yoke.

FIG. 9 is a partial front view of a fourth embodiment of piston rod 34C inserted in yoke 26. Yoke 26 includes pocket 48, shoulders 50, and projections 74. Piston rod 34C includes stem 56C and piston rod cap 58C. Piston rod cap 58C includes bottom portion 60C, top portion 62C, and recess 64C. Bottom portion 60C has bottom surface 65C. Top portion 62C has top surface 66C.

Yoke 26 has pocket 48 located at a bottom end of yoke 26. Shoulders 50 are located adjacent a bottom end of pocket 48. A bottom end of pocket 48 is narrower than a top end of pocket 48. Likewise, a top end of pocket 48 is wider than a bottom end of pocket 48. Projections 74 extend out of yoke 26 at the top of pocket 48 such that pocket 48 includes inward projections 74. Projections 74 may be annular or semi-annular. Projections 74 may be square-shaped as shown or may be saw-tooth-shaped, concave-cup-shaped, V-shaped, or any other suitable shape. In alternate embodiments, yoke 26 may include only one projection 74. Further, in alternate embodiments, projections 74 may be placed in alternate locations within pocket 48.

Piston rod 34C has stem 56C with a top end attached to piston rod cap 58C. Piston rod cap 58C has annular bottom portion 60C attached to the top end of stem 56C. Bottom portion 60C has an outer diameter that is larger than the outer diameter of stem 56C. Annular top portion 62C is at a top of piston rod cap 58C. Top portion 62C has an outer diameter that is larger than the outer diameter of stem 56C. Recess 64C is located in an exterior portion of piston rod cap 58C between bottom portion 60C and top portion 62C. Recess 64C has an outer diameter that is smaller than the outer diameters of bottom portion 60C and top portion 62C. Recess 64C is annular and extends an entire circumference of piston rod cap 58C. Recess 64C has a square-shaped cross-sectional profile and a constant diameter. Bottom portion 60C has annular bottom surface 65C at a bottom of bottom portion 60C. Bottom surface 65C connects to stem 56C. Top portion 62C has top surface 66C at a top of top portion 62C.

Yoke 26 receives a top end of piston rod 34C at pocket 48. When piston rod 34C is inserted in yoke 26, a first side of piston rod 34C is adjacent a first side of pocket 48 and a second side of piston rod 34C is adjacent a second side of pocket 48. More specifically, pocket 48 receives the top end of stem 56C and piston rod cap 58C. A bottom of pocket 48 is narrower than a top of pocket 48 to cooperate with stem 56C. Likewise, a top of pocket 48 is wider than a bottom of pocket 48 to cooperate with piston rod cap 58C. As such, yoke 26 is adjacent piston rod cap 58C at bottom surface 65C and at bottom portion 60C and top portion 62C. Projections 74 are adjacent piston rod cap 58C. A first projection 74 is adjacent a first side of piston rod cap 58C and a second projection 74 is adjacent a second side of piston rod cap 58C. Projections 74 extend into recess 64C of piston rod cap 58C as piston rod cap 58C is cradled by yoke 26. Recess 64C is shaped to cooperate with projections 74 of yoke 26. Recess 64C may be configured to match the shape of projections 74 such that a lock-and-key fit is formed between yoke 26 and piston rod cap 58C. In alternate embodiments, recess 64C may be slightly smaller than projections 74 such that a press fit is formed between yoke 26 and piston rod cap 58C. In alternate embodiments, projections 74 may only be adjacent a first side of piston rod cap 58C or a second side of piston rod cap 58C.

Recess 64C in piston rod cap 58C creates gaps between piston rod cap 58C and yoke 26 in pocket 48. The gaps created by recess 64C can trap paint, dirt, debris, particles, or other contamination. Such contamination is thus prevented from causing wear to various components of sprayer 10. Additionally, recess 64C reduces an outer circumferential surface area of piston rod cap 58C, which results in less interference with pocket 48 of yoke 26 by piston rod cap 58C. Therefore, despite a possible tight fit between piston rod 34C and yoke 26, piston rod 34C may release easier from pocket 48 due to less material causing interference during removal.

Figure 10:
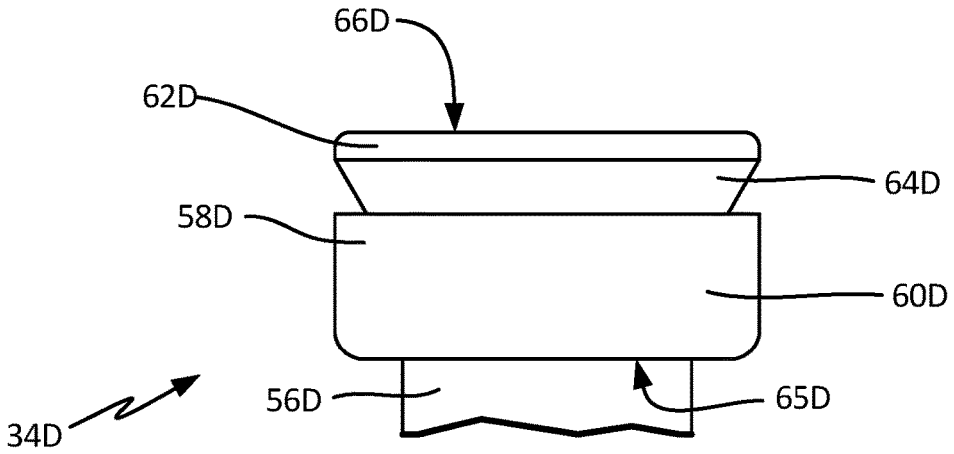
FIG. 10 is a partial front view of a fifth embodiment of the piston rod.

FIG. 10 is a partial front view of a fifth embodiment of piston rod 34D. Piston rod 34D includes stem 56D and piston rod cap 58D. Piston rod cap 58D includes bottom portion 60D, top portion 62D, and recess 64D. Bottom portion 60D has bottom surface 65D. Top portion 62D has top surface 66D.

Piston rod 34D has stem 56D with a top end attached to piston rod cap 58D. Piston rod cap 58D has annular bottom portion 60D attached to the top end of stem 56D. Bottom portion 60D has an outer diameter that is larger than the outer diameter of stem 56D. Annular top portion 62D is at a top of piston rod cap 58D. Top portion 62D has an outer diameter that is larger than the outer diameter of stem 56D. Recess 64D is located in an exterior portion of piston rod cap 58D between bottom portion 60D and top portion 62D. Recess 64D has an outer diameter that is smaller than the outer diameters of bottom portion 60D and top portion 62D. Recess 64D is annular and extends an entire circumference of piston rod cap 58D. Recess 64D has a saw-tooth-shaped cross-sectional profile. Recess 64D may cooperate with one or more projections 74 of yoke 26 as shown in FIG. 9. Bottom portion 60D has annular bottom surface 65D at a bottom of bottom portion 60D. Bottom surface 65D connects to stem 56D. Top portion 62D has top surface 66D at a top of top portion 62D.

Recess 64D in piston rod cap 58D creates gaps between piston rod cap 58D and yoke 26 (shown in FIG. 9). The gaps created by recess 64D can trap paint, dirt, debris, particles, or other contamination. Such contamination is thus prevented from causing wear to various components of sprayer 10. Additionally, recess 64D reduces an outer circumferential surface area of piston rod cap 58D, which results in less interference with pocket 48 (shown in FIG. 9) of yoke 26 by piston rod cap 58D. Therefore, despite a possible tight fit between piston rod 34D and yoke 26, piston rod 34D may release easier from pocket 48 due to less material causing interference during removal.

Figure 11A:
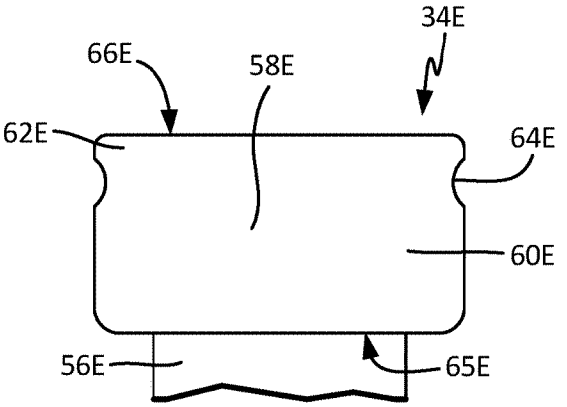
FIG. 11A is a partial front view of a sixth embodiment of the piston rod illustrating a recess as notches.

FIG. 11A is a partial front view of a sixth embodiment of piston rod 34E illustrating recesses 64E as notches. Piston rod 34E includes stem 56E and piston rod cap 58E. Piston rod cap 58E includes bottom portion 60E, top portion 62E, and recesses 64E. Bottom portion 60E has bottom surface 65E. Top portion 62E has top surface 66E.

Piston rod 34E has stem 56E with a top end attached to piston rod cap 58E. Piston rod cap 58E has annular bottom portion 60E attached to the top end of stem 56E. Bottom portion 60E has an outer diameter that is larger than the outer diameter of stem 56E. Annular top portion 62E is at a top of piston rod cap 58E. Top portion 62E has an outer diameter that is larger than the outer diameter of stem 56E. Recesses 64E are located in an exterior portion of piston rod cap 58E between bottom portion 60E and top portion 62E. Recesses 64E have outer diameters that are smaller than the outer diameters of bottom portion 60E and top portion 62E. Recesses 64E are notches or slots. Recesses 64E are not annular and do not extend an entire circumference of piston rod cap 58E. In this embodiment, recesses 64E are a plurality of notches. In alternate embodiments, recesses 64E may comprise a singular notch. Recesses 64E have rounded concave cup-shaped cross-sectional profiles. Recesses 64E may cooperate with one or more projections 74 of yoke 26 as shown in FIG. 9. Bottom portion 60E has annular bottom surface 65E at a bottom of bottom portion 60E. Bottom surface 65E connects to stem 56E. Top portion 62E has top surface 66E at a top of top portion 62E.

Recesses 64E create gaps between piston rod cap 58E and yoke 26 (shown in FIG. 9). The gaps created can trap paint, dirt, debris, particles, or other contamination. Such contamination is thus prevented from causing wear to various components of sprayer 10. Additionally, recesses 64E reduce an outer circumferential surface area of piston rod cap 58E, which results in less interference with pocket 48 (shown in FIG. 9) of yoke 26 by piston rod cap 58E. Therefore, despite a possible tight fit between piston rod 34E and yoke 26, piston rod 34E may release easier from pocket 48 due to less material causing interference during removal.

Figure 11B:
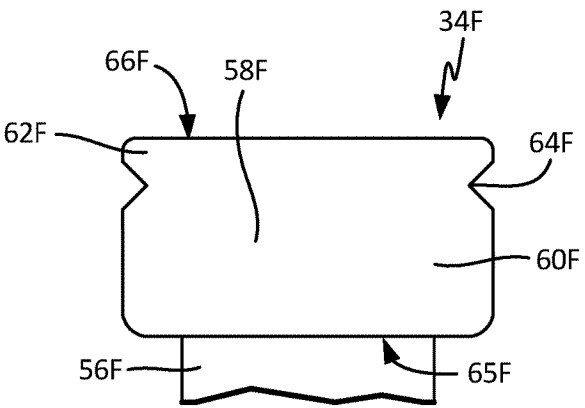
FIG. 11B is a partial front view of a seventh embodiment of the piston rod illustrating a recess as notches.

FIG. 11B is a partial front view of a seventh embodiment of piston rod 34F illustrating recesses 64F as notches. Piston rod 34F includes stem 56F and piston rod cap 58F. Piston rod cap 58F includes bottom portion 60F, top portion 62F, and recesses 64F. Bottom portion 60F has bottom surface 65F. Top portion 62F has top surface 66F.

Piston rod 34F has stem 56F with a top end attached to piston rod cap 58F. Piston rod cap 58F has annular bottom portion 60F attached to the top end of stem 56F. Bottom portion 60F has an outer diameter that is larger than the outer diameter of stem 56F. Annular top portion 62F is at a top of piston rod cap 58F. Top portion 62F has an outer diameter that is larger than the outer diameter of stem 56F. Recesses 64F are located in an exterior portion of piston rod cap 58F between bottom portion 60F and top portion 62F. Recesses 64F have outer diameters that are smaller than the outer diameters of bottom portion 60F and top portion 62F. Recesses 64F are notches or slots. Recesses 64F are not annular and do not extend an entire circumference of piston rod cap 58F. In this embodiment, recesses 64F are a plurality of notches. In alternate embodiments, recesses 64F may comprise a singular notch. Recesses 64F have V-shaped cross-sectional profiles. Recesses 64F may cooperate with one or more projections 74 of yoke 26 as shown in FIG. 9. Bottom portion 60F has annular bottom surface 65F at a bottom of bottom portion 60F. Bottom surface 65F connects to stem 56F. Top portion 62F has top surface 66F at a top of top portion 62F.

Recesses 64F create gaps between piston rod cap 58F and yoke 26 (shown in FIG. 9). The gaps created can trap paint, dirt, debris, particles, or other contamination. Such contamination is thus prevented from causing wear to various components of sprayer 10. Additionally, recesses 64F reduce an outer circumferential surface area of piston rod cap 58F, which results in less interference with pocket 48 (shown in FIG. 9) of yoke 26 by piston rod cap 58F. Therefore, despite a possible tight fit between piston rod 34F and yoke 26, piston rod 34F may release easier from pocket 48 due to less material causing interference during removal.

Figure 11C:
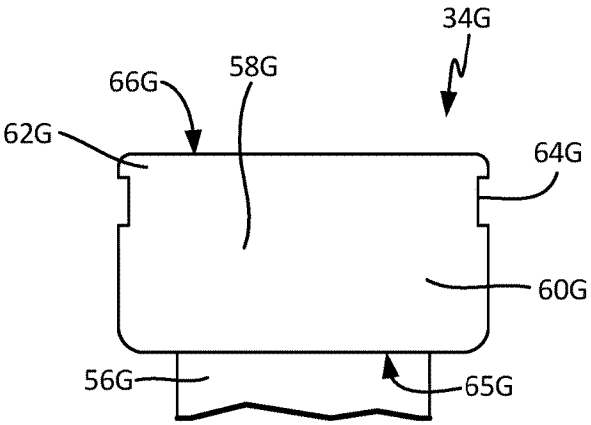
FIG. 11C is a partial front view of an eight embodiment of the piston rod illustrating a recess as notches.

FIG. 11C is a partial front view of an eighth embodiment of piston rod 34G illustrating recesses 64G as notches. Piston rod 34G includes stem 56G and piston rod cap 58G. Piston rod cap 58G includes bottom portion 60G, top portion 62G, and recesses 64G. Bottom portion 60G has bottom surface 65G. Top portion 62G has top surface 66G.

Piston rod 34G has stem 56G with a top end attached to piston rod cap 58G. Piston rod cap 58G has annular bottom portion 60G attached to the top end of stem 56G. Bottom portion 60G has an outer diameter that is larger than the outer diameter of stem 56G. Annular top portion 62G is at a top of piston rod cap 58G. Top portion 62G has an outer diameter that is larger than the outer diameter of stem 56G. Recesses 64G are located in an exterior portion of piston rod cap 58G between bottom portion 60G and top portion 62G. Recesses 64G have outer diameters that are smaller than the outer diameters of bottom portion 60G and top portion 62G. Recesses 64G are notches or slots. Recesses 64G are not annular and do not extend an entire circumference of piston rod cap 58G. In this embodiment, recesses 64G are a plurality of notches. In alternate embodiments, recesses 64G may comprise a singular notch. Recesses 64G have square-shaped cross-sectional profiles. Recesses 64G may cooperate with one or more projections 74 of yoke 26 as shown in FIG. 9. Bottom portion 60G has annular bottom surface 65G at a bottom of bottom portion 60G. Bottom surface 65G connects to stem 56G. Top portion 62G has top surface 66G at a top of top portion 62G.

Recesses 64G create gaps between piston rod cap 58G and yoke 26 (shown in FIG. 9). The gaps created can trap paint, dirt, debris, particles, or other contamination. Such contamination is thus prevented from causing wear to various components of sprayer 10. Additionally, recesses 64G reduce an outer circumferential surface area of piston rod cap 58G, which results in less interference with pocket 48 (shown in FIG. 9) of yoke 26 by piston rod cap 58G. Therefore, despite a possible tight fit between piston rod 34G and yoke 26, piston rod 34G may release easier from pocket 48 due to less material causing interference during removal.

Figure 11D:
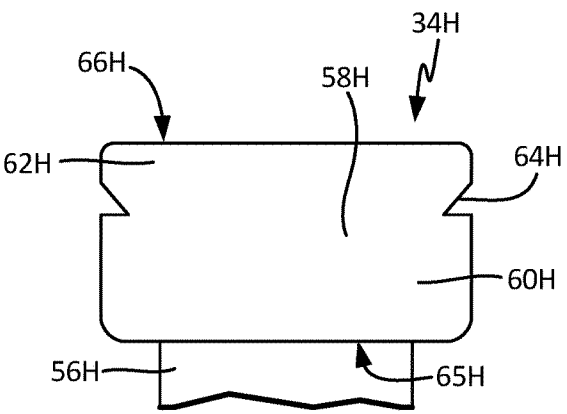
FIG. 11D is a partial front view of a ninth embodiment of the piston rod illustrating a recess as notches.

FIG. 11D is a partial front view of a ninth embodiment of piston rod 34H illustrating recesses 64H as notches. Piston rod 34H includes stem 56H and piston rod cap 58H. Piston rod cap 58H includes bottom portion 60H, top portion 62H, and recesses 64H. Bottom portion 60H has bottom surface 65H. Top portion 62H has top surface 66H.

Piston rod 34H has stem 56H with a top end attached to piston rod cap 58H. Piston rod cap 58H has annular bottom portion 60H attached to the top end of stem 56H. Bottom portion 60H has an outer diameter that is larger than the outer diameter of stem 56H. Annular top portion 62H is at a top of piston rod cap 58H. Top portion 62H has an outer diameter that is larger than the outer diameter of stem 56H. Recesses 64H are located in an exterior portion of piston rod cap 58H between bottom portion 60H and top portion 62H. Recesses 64H have outer diameters that are smaller than the outer diameters of bottom portion 60H and top portion 62H. Recesses 64H are notches or slots. Recesses 64H are not annular and do not extend an entire circumference of piston rod cap 58H. In this embodiment, recesses 64H are a plurality of notches. In alternate embodiments, recesses 64H may comprise a singular notch. Recesses 64H have saw-tooth-shaped cross-sectional profiles. Recesses 64H may cooperate with one or more projections 74 of yoke 26 as shown in FIG. 9. Bottom portion 60H has annular bottom surface 65H at a bottom of bottom portion 60H. Bottom surface 65H connects to stem 56H. Top portion 62H has top surface 66H at a top of top portion 62H.

Recesses 64H create gaps between piston rod cap 58H and yoke 26 (shown in FIG. 9). The gaps created can trap paint, dirt, debris, particles, or other contamination. Such contamination is thus prevented from causing wear to various components of sprayer 10. Additionally, recesses 64H reduce an outer circumferential surface area of piston rod cap 58H, which results in less interference with pocket 48 (shown in FIG. 9) of yoke 26 by piston rod cap 58H. Therefore, despite a possible tight fit between piston rod 34H and yoke 26, piston rod 34H may release easier from pocket 48 due to less material causing interference during removal.

Figure 12A:
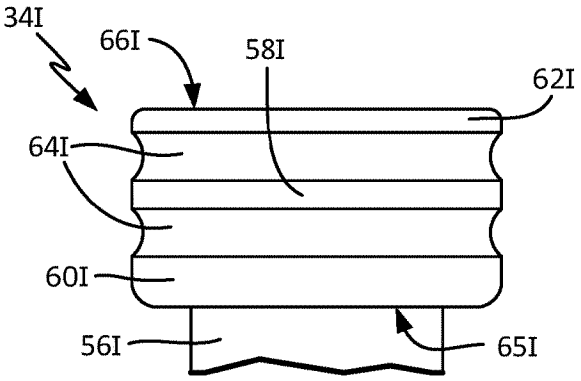
FIG. 12A is a partial front view of a tenth embodiment of the piston rod illustrating a plurality of spaced recesses.

FIG. 12A is a partial front view of a tenth embodiment of piston rod 34I illustrating a plurality of spaced recesses 64I.

Piston rod 34I includes stem 56I and piston rod cap 58I. Piston rod cap 58I includes bottom portion 60I, top portion 62I, and recesses 64I. Bottom portion 60I has bottom surface 65I. Top portion 62I has top surface 66I.

Piston rod 34I has stem 56I with a top end attached to piston rod cap 58I. Piston rod cap 58I has annular bottom portion 60I attached to the top end of stem 56I. Bottom portion 60I has an outer diameter that is larger than the outer diameter of stem 56I. Annular top portion 62I is at a top of piston rod cap 58I. Top portion 62I has an outer diameter that is larger than the outer diameter of stem 56I. Recesses 64I are located in an exterior portion of piston rod cap 58I between bottom portion 60I and top portion 62I. Recesses 64I have outer diameters that are smaller than the outer diameters of bottom portion 60I and top portion 62I. Recesses 64I are annular and extend an entire circumference of piston rod cap 58I. Recesses 64I are spaced from each other. In alternate embodiments, recesses 64I may be adjacent each other as shown in FIG. 8. Recesses 64I have rounded concave cup-shaped cross-sectional profiles. Recesses 64I may cooperate with one or more projections 74 of yoke 26 as shown in FIG. 9. Bottom portion 60I has annular bottom surface 65I at a bottom of bottom portion 60I. Bottom surface 65I connects to stem 56I. Top portion 62I has top surface 66I at a top of top portion 62I.

Recesses 64I create gaps between piston rod cap 58I and yoke 26 (shown in FIG. 9). The gaps created can trap paint, dirt, debris, particles, or other contamination. Such contamination is thus prevented from causing wear to various components of sprayer 10. Additionally, recesses 64I reduce an outer circumferential surface area of piston rod cap 58I, which results in less interference with pocket 48 (shown in FIG. 9) of yoke 26 by piston rod cap 58I. Therefore, despite a possible tight fit between piston rod 34I and yoke 26, piston rod 34I may release easier from pocket 48 due to less material causing interference during removal.

Figure 12B:
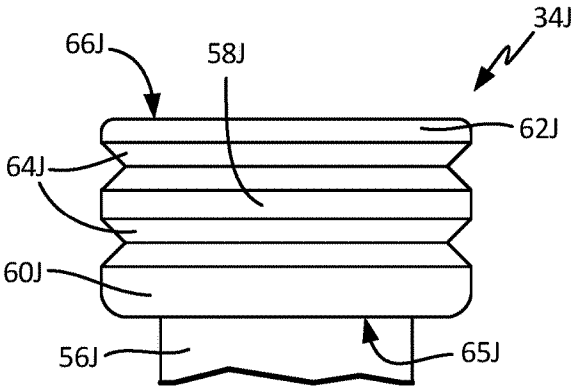
FIG. 12B is a partial front view of an eleventh embodiment of the piston rod illustrating a plurality of spaced recesses.

FIG. 12B is a partial front view of an eleventh embodiment of piston rod 34J illustrating a plurality of spaced recesses 64J. Piston rod 34J includes stem 56J and piston rod cap 58J. Piston rod cap 58J includes bottom portion 60J, top portion 62J, and recesses 64J. Bottom portion 60J has bottom surface 65J. Top portion 62J has top surface 66J.

Piston rod 34J has stem 56J with a top end attached to piston rod cap 58J. Piston rod cap 58J has annular bottom portion 60J attached to the top end of stem 56J. Bottom portion 60J has an outer diameter that is larger than the outer diameter of stem 56J. Annular top portion 62J is at a top of piston rod cap 58J. Top portion 62J has an outer diameter that is larger than the outer diameter of stem 56J. Recesses 64J are located in an exterior portion of piston rod cap 58J between bottom portion 60J and top portion 62J. Recesses 64J have outer diameters that are smaller than the outer diameters of bottom portion 60J and top portion 62J. Recesses 64J are annular and extend an entire circumference of piston rod cap 58J. Recesses 64J are spaced from each other. In alternate embodiments, recesses 64J may be adjacent each other as shown in FIG. 8. Recesses 64J have V-shaped cross-sectional profiles. Recesses 64J may cooperate with one or more projections 74 of yoke 26 as shown in FIG. 9. Bottom portion 60J has annular bottom surface 65J at a bottom of bottom portion 60J. Bottom surface 65J connects to stem 56J. Top portion 62J has top surface 66J at a top of top portion 62J.

Recesses 64J create gaps between piston rod cap 58J and yoke 26 (shown in FIG. 9). The gaps created can trap paint, dirt, debris, particles, or other contamination. Such contamination is thus prevented from causing wear to various components of sprayer 10. Additionally, recesses 64J reduce an outer circumferential surface area of piston rod cap 58J, which results in less interference with pocket 48 (shown in FIG. 9) of yoke 26 by piston rod cap 58J. Therefore, despite a possible tight fit between piston rod 34J and yoke 26, piston rod 34J may release easier from pocket 48 due to less material causing interference during removal.

Figure 12C:
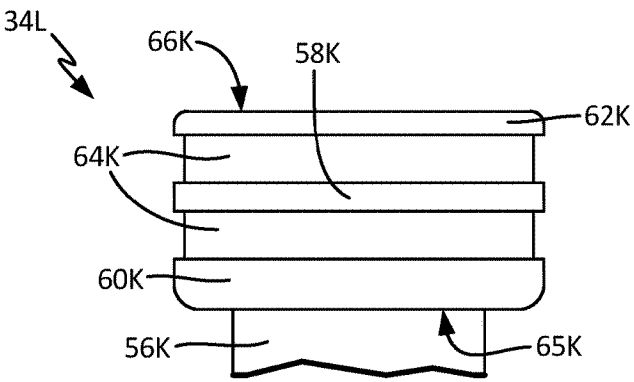
FIG. 12C is a partial front view of a twelfth embodiment of the piston rod illustrating a plurality of spaced recesses.

FIG. 12C is a partial front view of a twelfth embodiment of piston rod 34K illustrating a plurality of spaced recesses 64K. Piston rod 34K includes stem 56K and piston rod cap 58K. Piston rod cap 58K includes bottom portion 60K, top portion 62K, and recesses 64K. Bottom portion 60K has bottom surface 65K. Top portion 62K has top surface 66K.

Piston rod 34K has stem 56K with a top end attached to piston rod cap 58K. Piston rod cap 58K has annular bottom portion 60K attached to the top end of stem 56K. Bottom portion 60K has an outer diameter that is larger than the outer diameter of stem 56K. Annular top portion 62K is at a top of piston rod cap 58K. Top portion 62K has an outer diameter that is larger than the outer diameter of stem 56K. Recesses 64K are located in an exterior portion of piston rod cap 58K between bottom portion 60K and top portion 62K. Recesses 64K have outer diameters that are smaller than the outer diameters of bottom portion 60K and top portion 62K. Recesses 64K are annular and extend an entire circumference of piston rod cap 58K. Recesses 64K are spaced from each other. In alternate embodiments, recesses 64K may be adjacent each other as shown in FIG. 8. Recesses 64K have square-shaped cross-sectional profiles. Recesses 64K may cooperate with one or more projections 74 of yoke 26 as shown in FIG. 9. Bottom portion 60K has annular bottom surface 65K at a bottom of bottom portion 60K. Bottom surface 65K connects to stem 56K. Top portion 62K has top surface 66K at a top of top portion 62K.

Recesses 64K create gaps between piston rod cap 58K and yoke 26 (shown in FIG. 9). The gaps created can trap paint, dirt, debris, particles, or other contamination. Such contamination is thus prevented from causing wear to various components of sprayer 10. Additionally, recesses 64K reduce an outer circumferential surface area of piston rod cap 58K, which results in less interference with pocket 48 (shown in FIG. 9) of yoke 26 by piston rod cap 58K. Therefore, despite a possible tight fit between piston rod 34K and yoke 26, piston rod 34K may release easier from pocket 48 due to less material causing interference during removal.

Figure 12D:
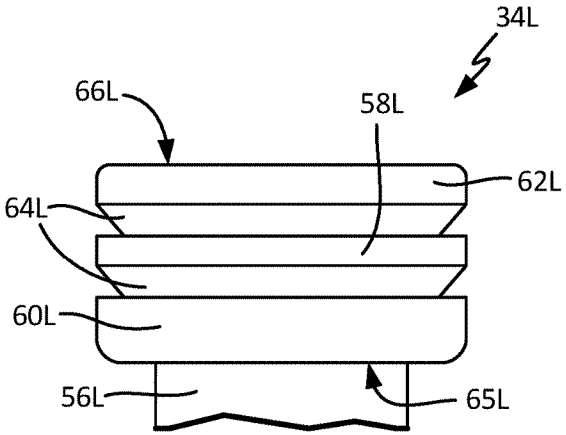
FIG. 12D is a partial front view of a thirteenth embodiment of the piston rod illustrating a plurality of spaced recesses.

FIG. 12D is a partial front view of a thirteenth embodiment of piston rod 34L illustrating a plurality of spaced recesses 64L. Piston rod 34L includes stem 56L and piston rod cap 58L. Piston rod cap 58L includes bottom portion 60L, top portion 62L, and recesses 64L. Bottom portion 60L has bottom surface 65L. Top portion 62L has top surface 66L.

Piston rod 34L has stem 56L with a top end attached to piston rod cap 58L. Piston rod cap 58L has annular bottom portion 60L attached to the top end of stem 56L. Bottom portion 60L has an outer diameter that is larger than the outer diameter of stem 56L. Annular top portion 62L is at a top of piston rod cap 58L. Top portion 62L has an outer diameter that is larger than the outer diameter of stem 56L. Recesses 64L are located in an exterior portion of piston rod cap 58L between bottom portion 60L and top portion 62L. Recesses 64L have outer diameters that are smaller than the outer diameters of bottom portion 60L and top portion 62L. Recesses 64L are annular and extend an entire circumference of piston rod cap 58L. Recesses 64L are spaced from each other. In alternate embodiments, recesses 64L may be adjacent each other as shown in FIG. 8. Recesses 64L have saw-tooth-shaped cross-sectional profiles. Recesses 64L may cooperate with one or more projections 74 of yoke 26 as shown in FIG. 9. Bottom portion 60L has annular bottom surface 65L at a bottom of bottom portion 60L. Bottom surface 65L connects to stem 56L. Top portion 62L has top surface 66L at a top of top portion 62L.

Recesses 64L create gaps between piston rod cap 58L and yoke 26 (shown in FIG. 9). The gaps created can trap paint, dirt, debris, particles, or other contamination. Such contamination is thus prevented from causing wear to various components of sprayer 10. Additionally, recesses 64L reduce an outer circumferential surface area of piston rod cap 58L, which results in less interference with pocket 48 (shown in FIG. 9) of yoke 26 by piston rod cap 58L. Therefore, despite a possible tight fit between piston rod 34L and yoke 26, piston rod 34L may release easier from pocket 48 due to less material causing interference during removal.

DISCUSSION OF POSSIBLE EMBODIMENTS

The following are non-exclusive descriptions of possible embodiments of the present disclosure.

A piston rod for pumping paint includes an elongated cylindrical stem, the cylindrical stem being formed from metal and having an outer diameter that is uniform along most or all of a length of the cylindrical stem; and a piston rod cap connected to the cylindrical stem, the piston rod cap being cylindrical and formed from metal, the piston rod cap comprising: an annular top portion having an outer diameter that is larger than the outer diameter of the cylindrical stem; an annular bottom portion having an outer diameter that is larger than the outer diameter of the cylindrical stem; and an exterior recess located between the annular top and bottom portions, the recess having an outer diameter that is smaller than the outer diameters of the annular top and bottom portions.

The piston rod of the preceding paragraph can optionally include, additionally and/or alternatively, any one or more of the following features, configurations and/or additional components:

- The outer diameters of the annular top and bottom portions are equal.
- The recess is a groove that extends entirely around a circumference of the piston rod cap.
- A bottom of the cylindrical stem is configured to contact paint and pump the paint by reciprocation of the cylindrical stem.
- The cylindrical stem is formed from a separate piece of metal than the piston rod cap.
- The piston rod cap comprises a cavity that receives the cylindrical stem.
- The piston rod cap is press fit on a top of the cylindrical stem to fix the piston rod cap to the cylindrical stem.
- The outer diameter of the cylindrical stem is uniform along the entire length of the cylindrical stem.
- The piston rod consists only of the cylindrical stem and the piston rod cap.
- The recess has a rounded concave-shaped cross-sectional profile.
- The recess has a cross-sectional profile selected from the group consisting of: a
- V-shaped cross-section, a saw-tooth-shaped cross-section, and a square-shaped cross-section.
- The annular top portion of the piston rod cap comprises a top surface that is flat.
- The annular bottom portion of the piston rod cap comprises an annular bottom surface that is flat.
- The recess is configured to trap contaminants.
- The recess has a depth in the range of 0.010 to 0.125 inches, and the recess has a height in the range of 0.030 to 0.375 inches.

A piston rod assembly includes the piston rod defined above; and a packing retainer that surrounds a portion of the cylindrical stem such that the cylindrical stem extends out of opposite sides of the packing retainer and the piston rod cap is outside of the packing retainer, the packing retainer holding one or more packing seal rings around and in contact with the cylindrical stem.

A piston pump assembly includes the piston rod defined above; and a yoke having a pocket, the pocket having a bottom portion that is narrower than a top portion of the pocket, and the piston rod being insertable into the pocket of the yoke such that the yoke cradles the piston rod cap to linearly move the piston rod as the yoke moves.

The piston pump assembly defined above, wherein the pocket further comprises one or more inward projections that extend into the recess of the piston rod cap as the piston rod cap is cradled by the yoke.

A piston rod for pumping paint includes an elongated cylindrical stem formed from a first piece of metal, the cylindrical stem having an outer diameter that is uniform along most or all of a length of the cylindrical stem; and a piston rod cap connected to the cylindrical stem and formed from a second piece of metal that is separate from the first piece of metal, the piston rod cap comprising: an annular top portion having an outer diameter that is larger than the outer diameter of the cylindrical stem, the annular top portion having a top surface that is flat; an annular bottom portion having an outer diameter that is larger than the outer diameter of the cylindrical stem; an exterior recess located between the annular top and bottom portions and having an outer diameter that is smaller than the outer diameters of the annular top and bottom portions, the recess comprising an annular groove that extends around an entire circumference of the piston rod cap; and a cavity that receives a top portion of the cylindrical stem.

A piston pump assembly for pumping paint includes a piston rod comprising: an elongated cylindrical stem formed from a first piece of metal, the cylindrical stem having an outer diameter that is uniform along most or all of a length of the cylindrical stem; and a piston rod cap connected to the cylindrical stem, the piston rod cap comprising: an annular top portion having an outer diameter that is larger than the outer diameter of the cylindrical stem, the annular top portion having a top surface that is flat; an annular bottom portion having an outer diameter that is larger than the outer diameter of the cylindrical stem, the annular bottom portion having an annular bottom surface that is flat; a recess located between the annular top and bottom portions and smaller in outer diameter than the annular top and bottom portions, the recess comprising an annular groove that extends around an entire circumference of the piston rod cap; and a cavity that receives a top portion of the cylindrical stem to connect the piston rod cap to the cylindrical stem; and a packing retainer that surrounds a portion of the cylindrical stem such that the cylindrical stem extends out of opposite sides of the packing retainer and the piston rod cap is outside of the packing retainer, the packing retainer holding one or more packing seal rings around and in contact with the cylindrical stem.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A piston rod for pumping paint, the piston rod comprising:

an elongated cylindrical stem, the cylindrical stem being formed from metal and having an outer diameter that is uniform along most or all of a length of the cylindrical stem; and a piston rod cap connected to the cylindrical stem, the piston rod cap being cylindrical and formed from metal, the piston rod cap comprising:

an annular top portion having an outer diameter that is larger than the outer diameter of the cylindrical stem;

an annular bottom portion having an outer diameter that is larger than the outer diameter of the cylindrical stem; and an exterior recess located between the annular top and bottom portions, the recess having an outer diameter that is smaller than the outer diameters of the annular top and bottom portions;

wherein the recess has a depth in the range of 0.010 to 0.125 inches, and the recess has a height in the range of 0.030 to 0.375 inches.

2. The piston rod of claim 1, wherein the outer diameters of the annular top and bottom portions are equal.

3. The piston rod of claim 1, wherein the recess is a groove that extends entirely around a circumference of the piston rod cap.

4. The piston rod of claim 1, wherein a bottom of the cylindrical stem is configured to contact paint and pump the paint by reciprocation of the cylindrical stem.

5. The piston rod of claim 1, wherein the cylindrical stem is formed from a separate piece of metal than the piston rod cap.

6. The piston rod of claim 1, wherein the piston rod cap comprises a cavity that receives the cylindrical stem.

7. The piston rod of claim 1, wherein the piston rod cap is press fit on a top of the cylindrical stem to fix the piston rod cap to the cylindrical stem.

8. The piston rod of claim 1, wherein the outer diameter of the cylindrical stem is uniform along the entire length of the cylindrical stem.

9. The piston rod of claim 1, wherein the piston rod consists only of the cylindrical stem and the piston rod cap.

10. The piston rod of claim 1, wherein the recess has a rounded concave-shaped cross-sectional profile.

11. The piston rod of claim 1, wherein the recess has a cross-sectional profile selected from the group consisting of: a V-shaped cross-section, a saw-tooth-shaped cross-section, and a square-shaped cross-section.

12. The piston rod of claim 1, wherein the annular top portion of the piston rod cap comprises a top surface that is flat.

13. The piston rod of claim 1, wherein the annular bottom portion of the piston rod cap comprises an annular bottom surface that is flat.

14. The piston rod of claim 1, wherein the recess is configured to trap contaminants.

15. A piston rod assembly comprising:

a piston rod according to claim 1; and a packing retainer that surrounds a portion of the cylindrical stem such that the cylindrical stem extends out of opposite sides of the packing retainer and the piston rod cap is outside of the packing retainer, the packing retainer holding one or more packing seal rings around and in contact with the cylindrical stem.

16. A piston pump assembly comprising:

a piston rod according to claim 1; and a yoke having a pocket, the pocket having a bottom portion that is narrower than a top portion of the pocket, and the piston rod being insertable into the pocket of the yoke such that the yoke cradles the piston rod cap to linearly move the piston rod as the yoke moves.

17. The piston pump assembly of claim 16, wherein the pocket further comprises one or more inward projections that extend into the recess of the piston rod cap as the piston rod cap is cradled by the yoke.

18. A piston rod for pumping paint comprising:

an elongated cylindrical stem formed from a first piece of metal, the cylindrical stem having an outer diameter that is uniform along most or all of a length of the cylindrical stem; and a piston rod cap connected to the cylindrical stem and formed from a second piece of metal that is separate from the first piece of metal, the piston rod cap comprising:

an annular top portion having an outer diameter that is larger than the outer diameter of the cylindrical stem, the annular top portion having a top surface that is flat;

an annular bottom portion having an outer diameter that is larger than the outer diameter of the cylindrical stem;

an exterior recess located between the annular top and bottom portions and having an outer diameter that is smaller than the outer diameters of the annular top and bottom portions, the recess comprising an annular groove that extends around an entire circumference of the piston rod cap; and a cavity that receives a top portion of the cylindrical stem;

wherein the recess has a depth in the range of 0.010 to 0.125 inches, and the recess has a height in the range of 0.030 to 0.375 inches.

19. A piston pump assembly for pumping paint comprising:

a piston rod comprising:

an elongated cylindrical stem formed from a first piece of metal, the cylindrical stem having an outer diameter that is uniform along most or all of a length of the cylindrical stem; and a piston rod cap connected to the cylindrical stem, the piston rod cap comprising:

an annular top portion having an outer diameter that is larger than the outer diameter of the cylindrical stem, the annular top portion having a top surface that is flat;

an annular bottom portion having an outer diameter that is larger than the outer diameter of the cylindrical stem, the annular bottom portion having an annular bottom surface that is flat;

a recess located between the annular top and bottom portions and smaller in outer diameter than the annular top and bottom portions, the recess comprising an annular groove that extends around an entire circumference of the piston rod cap, wherein the recess has a depth in the range of 0.010 to 0.125 inches, and the recess has a height in the range of 0.030 to 0.375 inches; and a cavity that receives a top portion of the cylindrical stem to connect the piston rod cap to the cylindrical stem; and a packing retainer that surrounds a portion of the cylindrical stem such that the cylindrical stem extends out of opposite sides of the packing retainer and the piston rod cap is outside of the packing retainer, the packing retainer holding one or more packing seal rings around and in contact with the cylindrical stem.

20. A piston rod for pumping paint, the piston rod comprising:

an elongated cylindrical stem, the cylindrical stem being formed from metal and having an outer diameter that is uniform along most or all of a length of the cylindrical stem; and a piston rod cap connected to the cylindrical stem, the piston rod cap being cylindrical and formed from metal, the piston rod cap comprising:

an annular top portion having an outer diameter that is larger than the outer diameter of the cylindrical stem;

an annular bottom portion having an outer diameter that is larger than the outer diameter of the cylindrical stem; and an exterior recess located between the annular top and bottom portions, the recess having an outer diameter that is smaller than the outer diameters of the annular top and bottom portions;

wherein the piston rod cap is press fit on a top of the cylindrical stem to fix the piston rod cap to the cylindrical stem;

wherein the recess has a depth in the range of 0.010 to 0.125 inches, and the recess has a height in the range of 0.030 to 0.375 inches.

21. The piston rod of claim 20, wherein the outer diameters of the annular top and bottom portions are equal.

22. The piston rod of claim 20, wherein the outer diameter of the cylindrical stem is uniform along the entire length of the cylindrical stem.

23. The piston rod of claim 20, wherein the piston rod consists only of the cylindrical stem and the piston rod cap.

24. The piston rod of claim 20, wherein the annular top portion of the piston rod cap comprises a top surface that is flat.

25. A piston rod for pumping paint, the piston rod comprising:

an elongated cylindrical stem, the cylindrical stem being formed from metal and having an outer diameter that is uniform along most or all of a length of the cylindrical stem; and a piston rod cap connected to the cylindrical stem, the piston rod cap being cylindrical and formed from metal, the piston rod cap comprising:

an annular top portion having an outer diameter that is larger than the outer diameter of the cylindrical stem;

an annular bottom portion having an outer diameter that is larger than the outer diameter of the cylindrical stem; and an exterior recess located between the annular top and bottom portions, the recess having an outer diameter that is smaller than the outer diameters of the annular top and bottom portions;

wherein the recess is configured to trap contaminants.

26. The piston rod of claim 25, wherein the outer diameters of the annular top and bottom portions are equal.

27. The piston rod of claim 25, wherein the recess is a groove that extends entirely around a circumference of the piston rod cap.

28. The piston rod of claim 25, wherein the cylindrical stem is formed from a separate piece of metal than the piston rod cap.

29. The piston rod of claim 25, wherein the piston rod cap comprises a cavity that receives the cylindrical stem.

30. The piston rod of claim 25, wherein the piston rod cap is press fit on a top of the cylindrical stem to fix the piston rod cap to the cylindrical stem.

31. The piston rod of claim 25, wherein the outer diameter of the cylindrical stem is uniform along the entire length of the cylindrical stem.

32. The piston rod of claim 25, wherein the piston rod consists only of the cylindrical stem and the piston rod cap.

33. The piston rod of claim 25, wherein the annular top portion of the piston rod cap comprises a top surface that is flat.

34. The piston rod of claim 25, wherein the annular bottom portion of the piston rod cap comprises an annular bottom surface that is flat.

35. A piston rod assembly comprising:

a piston rod according to claim 25; and a packing retainer that surrounds a portion of the cylindrical stem such that the cylindrical stem extends out of opposite sides of the packing retainer and the piston rod cap is outside of the packing retainer, the packing retainer holding one or more packing seal rings around and in contact with the cylindrical stem.

36. A piston rod for pumping paint, the piston rod comprising:

an elongated cylindrical stem, the cylindrical stem being formed from metal and having an outer diameter that is uniform along most or all of a length of the cylindrical stem; and a piston rod cap connected to the cylindrical stem, the piston rod cap being cylindrical and formed from metal, the piston rod cap comprising:

an annular top portion having an outer diameter that is larger than the outer diameter of the cylindrical stem;

an annular bottom portion having an outer diameter that is larger than the outer diameter of the cylindrical stem; and an exterior recess located between the annular top and bottom portions, the recess having an outer diameter that is smaller than the outer diameters of the annular top and bottom portions;

wherein the recess has a rounded concave-shaped cross-sectional profile.

37. A piston rod for pumping paint, the piston rod comprising:

an elongated cylindrical stem, the cylindrical stem being formed from metal and having an outer diameter that is uniform along an entire length of the cylindrical stem; and a piston rod cap connected to the cylindrical stem, the piston rod cap being cylindrical and formed from metal, the piston rod cap comprising:

an annular top portion having an outer diameter that is larger than the outer diameter of the cylindrical stem;

an annular bottom portion having an outer diameter that is larger than the outer diameter of the cylindrical stem; and an exterior recess located between the annular top and bottom portions, the recess having an outer diameter that is smaller than the outer diameters of the annular top and bottom portions;

wherein the piston rod consists only of the cylindrical stem and the piston rod cap;

wherein the recess has a depth in the range of 0.010 to 0.125 inches, and the recess has a height in the range of 0.030 to 0.375 inches.

* * * * *